United States Patent [19]

Kose et al.

[11] Patent Number: 4,914,835

[45] Date of Patent: Apr. 10, 1990

[54] METHOD OF AND APPARATUS FOR DRYING PHOTOGRAPHIC LIGHT-SENSITIVE MATERIAL IN PHOTOGRAPHIC PROCESSING MACHINE

[75] Inventors: Junichi Kose; Yoshiyasu Matsuzaki; Motoharu Komori; Nobuyuki Seto; Miyuki Endo; Kimitaka Kameoka; Takashi Naoi; Yasunobu Tanaka; Tomoyuki Takiue, all of Kanagawa, Japan

[73] Assignee: Fuji Photo Film Co., Ltd., Kanagawa, Japan

[21] Appl. No.: 172,687

[22] Filed: Mar. 23, 1988

[30] Foreign Application Priority Data

| | | | |
|---|---|---|---|
| Mar. 23, 1987 | [JP] | Japan | 62-68530 |
| Mar. 25, 1987 | [JP] | Japan | 62-71126 |
| Mar. 25, 1987 | [JP] | Japan | 62-71127 |
| May 6, 1987 | [JP] | Japan | 62-109984 |

[51] Int. Cl.[4] ..... F26B 19/00; G03D 3/13

[52] U.S. Cl. ..... 34/31; 34/48; 34/56; 34/155; 354/299

[58] Field of Search ..... 34/150, 155, 158, 26, 34/30, 31, 48, 52, 46, 50, 53, 55, 56; 354/299, 319, 320, 321, 322

[56] References Cited

U.S. PATENT DOCUMENTS

| | | | |
|---|---|---|---|
| 3,707,777 | 1/1973 | Geyken et al. | 34/48 |
| 4,245,397 | 1/1981 | Laar et al. | 34/155 X |
| 4,316,663 | 2/1982 | Fischer | 34/155 X |

FOREIGN PATENT DOCUMENTS 56-95239 8/1981 Japan .

58-138939 9/1983 Japan .

OTHER PUBLICATIONS

Research Paper by Hirohisa Obara et al, Dimensional Stability of Graphic Arts Film, Research Laboratory of Ashigara of Fuji Photo Film Co., Ltd., May 20, 1983 in Tokyo Japan and English translations of sections 3-2 and 4 of the Obara et al research paper.

*Primary Examiner*—Harry B. Tanner

*Attorney, Agent, or Firm*—Sughrue, Mion, Zinn, Macpeak & Seas

[57] ABSTRACT

In a method of drying a photographic light-sensitive material by use of drying air, the amount of light-sensitive material which can be processed within a predetermined time at a set temperature of the drying air is compared with the totalized amount of the light-sensitive material to be actually processed within the predetermined time, and, on the basis of the result of this comparison, the set temperature of the drying air can be adjusted. An apparatus for drying photographic light-sensitive material by use of drying air is arranged so that the amount of light-sensitive material to be actually processed within a predetermined time is detected by a detecting sensor and the thus-detected amount is compared with the amount of light-sensitive material which can be dried. If the amount of light-sensitive material to be actually processed exceeds the amount of light-sensitive material which can be processed, such a display is conducted that the apparatus is not ready for insertion of further light-sensitive material. Accordingly, the light-sensitive material can consistently be dried at a proper drying temperature.

20 Claims, 24 Drawing Sheets

METHOD OF AND APPARATUS FOR DRYING PHOTOGRAPHIC LIGHT-SENSITIVE MATERIAL IN PHOTOGRAPHIC PROCESSING MACHINE

BACKGROUND OF THE INVENTION

1. Field of the Invention

The present invention relates generally to a photographic processing machine and, more particularly, to a method of and an apparatus for drying photographic light-sensitive material, such as film sheet, by applying drying air thereto in the photographic processing machine.

2. Description of the Related Art

In such a photographic processing machine, particularly, a typical automatic developing machine, a drying device is arranged in such a manner that, immediately after a power switch of the automatic developing machine has been turned on, a fan and a heater are turned on to introduce the outside air from an air inlet and supply warm air through an air duct to a drying chamber, and thereby the interior of the drying chamber is heated.

More specifically, the outside air which is introduced through the air inlet is heated by the heater irrespective of the condition of the introduced air (for example, temperature and humidity). Thus, the relative humidity of the introduced air is reduced and the temperature of a film sheet to be dried by warm air is raised, to evaporate moisture from the film sheet. The warm air containing the moisture is discharged from the machine.

However, in a case where a film sheet is dried by using such a device, the moisture carried on, or contained in, the sheet is evaporated and discharged irrespective of the ambient temperature, humidities, and other conditions of the outside air. Therefore, if the amount of sheet to be processed per unit time is large, if the ambient temperature is low, or if the ambient humidity is high, the temperature in the drying chamber may not reach a predetermined temperature under the same conditions that warm air is supplied, or humidity may become excessively high. As a result, the environment within the drying chamber deteriorates with time, and thus film sheets may stick each other because imperfect dryness or nonuniform dryness may take place. For these reasons, a heater and a fan each having a capability which corresponds to the maximum amount of film sheets to be processed per unit time are needed. This causes the problem of increases in the size of the apparatus and the cost of production. Otherwise, the film sheet may be excessively dried, and thus the curl or nonuniform dryness thereof may take place.

It is therefore an object of the present invention to provide a method of and an apparatus for drying photographic light-sensitive material, both of which are suitable for applications in a photographic processing machine for light-sensitive material, and both of which are capable of maintaining a necessary and appropriate degree of dryness by using a minimum required level of energy (the temperature and flow rate of warm air) to achieve a suitable dryness of the photographic light-sensitive materials.

SUMMARY OF THE INVENTION

In accordance with a first aspect of the present invention, there is provided a method of drying photographic light-sensitive material, such as film sheet, by use of drying air after the photographic light-sensitive material has been processed in a photographic processing machine, comprising the steps of:

(a) setting drying temperature of the drying air necessary for, drying a predetermined amount of the processed light-sensitive material within a predetermined time;

(b) periodically performing arithmetic operations concerning the totalized amount of the light-sensitive material to be actually dried within the predetermined time; and (c) making a comparison between the predetermined amount of the light-sensitive material and the totalized amount, thereby adjusting the set temperature of drying air on the basis of the result of said comparison.

When film sheet is inserted into the photographic processing machine, the amount of film sheet inserted (the amount of film to be processed) is detected. The amount of film inserted may be represented by, for example, the number of film sheets or area of film. In this case, if a limit switch is disposed at an intermediate position on a path along which the film sheet is conveyed and, if the limit switch is arranged so as to be turned on and off each time a film sheet goes past the limit switch, the number of film sheets can be readily detected. In this case, it is required that film sheets having substantially the same configuration are conveyed in sheet-by-sheet fashion. Also, a photoelectric sensor may be disposed in such a manner that a film sheet may be passed through an optical axis which extends from the light emitting side of the sensor to the light receiving side of the same. Each time the film sheet passes through the optical axis, the light on the optical axis is blocked by the film sheet. Even if the size of the film sheets to be inserted is different, the area of film inserted may be detected as the amount of film inserted by use of a plurality of the sensors disposed at right angles to the direction of conveying the film sheet.

After completion of processing, the film sheet is conveyed to a drying chamber, dried therein, and discharged from the processing machine. It is to be noted that the term "processing" includes processes such as development, fixation, and washing. Since the drying air is controlled so as to be maintained at the set drying temperature, an optimum degree of dryness can be achieved.

In this case, the environment (temperature and humidity) in the drying chamber varies with in the amount of film (e.g., the number of film sheets) processed per unit time. Therefore, in the present invention, the set drying temperature of warm air which corresponds to a predetermined amount (predetermined number of film sheets) of film to be processed during predetermined period is determined in advance. This predetermined amount (predetermined number of film sheets) is compared with the totalized amount of film (the totalized number of film sheets) which is actually processed. On the basis of the result of this comparison, the set drying temperature of the drying air is adjusted.

More specifically, the amount (number of film sheets) of film processed per unit time depends upon the intervals between successive insertions. Therefore, the environment in the drying chamber varied with the amount of film can be restored to an optimum condition by adjusting periodically the set drying temperature of warm air in accordance with the totalized amount of film (or totalized number of film sheets) which is acutally processed.

Next, if the film is dried irrespective of the ambient temperature and humidity, the following problem will occur.

As shown in FIG. 20, the film sheet 981 has a polyester film base (hereinafter referred to as PET) 982, an emulsion layer 984 applied to one side surface of the PET and a backing layer 986 containing gelatin and dye.

It is known that the size of the film 981 is changed due to heat and water content in the same manner as ordinary various material.

In case that the size of the film 981 which has been just exposed (a point P in FIG. 21) is substantially equal to that of the film 981 which has been just dried (a point $A_0$ in FIG. 21), no problem occurs in the film 981 even if the size thereof is changed in the process between the exposure and the dryness (in the developing process shown with a point W in FIG. 21). However, as shown with an imaginary line in FIG. 20, when the film 981 contains much water due to the developing process, the elasticity of each layers 84, 86 containing gelatin is lost. In such a case only the stretch of the PET 982 can be measured.

When the film 981 put in such a condition is dried in the subsequent step, the film 981 is contracted. However, the amount of contraction is different among the PET 982, the emulsion layer 984 and the backing layer 986, as shown with a dotted line in FIG. 20. In this case the amounts of contraction of the layers 984, 986 are restricted by the PET 982, so that the layers 984, 986 are kept in their stretched condition. Thus, each of the layers 984, 986 is stretched so that it loses the elasticity. As a result, even though the temperature and the water content of the film 981 is returned back to those of the film before the film is developed, the film 981 is not returned back to its original size i.e., the size before the film is developed, so that the film is maintained in its stretched condition a difference occurs between the size of the film which has been just exposed and that of the film which has been just dried (referred to as a size G in FIG. 21).

Such a method of drying photographic light-sensitive material such as film sheet is preferable which makes the size of the film sheet which has been just dried equal to that of the film sheet which has been subjected to an exposure processing.

In accordance with a second aspect of the present invention, there is provided a method of drying photographic light-sensitive material, such as film sheet, by use of drying air in a drying chamber after said photographic light-sensitive material has been processed in a processing machine for photographic light-sensitive material, comprising the steps of (a) detecting the ambient temperature and humidity around said processing machine; and (b) controlling a temperature of said drying air on the basis of the ambient temperature and humidity to adjust the temperature in said drying chamber at a temperature of an optimum drying temperature at which the water content of the photographic light-sensitive material which has been just discharged from the drying chamber is equivalent substantially to the water content in the ambient condition around said processing machine or less than said optimum drying temperature.

When the film sheet is exposed, the film sheet has a water content equivalent to the water content (humidity) in the ambient condition around the processing machine when the film sheet is subjected to such a processing as developing, the film sheet absorbs water to stretch.

In case that the film sheet is dried at a temperature of more than the optimum drying temperature, the emulsion layer and the backing layer of the film sheet are stretched by the film base in the course of the drying process.

However, when the film sheet is dried at the optimum drying temperature in the drying chamber, the above layers are not stretched, so that the elasticity of each layer is not lost.

Accordingly, the film sheet can be returned back to the condition of the film sheet which has been just exposed, whereby the difference does not occurs between the size of the film sheet which has been just exposed and that of the film sheet which has been just dried. Thus, the film sheet can be dried to an optimum condition.

It is necessary to set the temperature in the drying chamber to the optimum drying temperature or less but it does not means that the lower the temperature the more preferable the film sheet is. That is to say, the drying chamber should be set to a temperature of more than such a temperature that the film sheet which has been just discharged from the drying chamber has the water content which is more than the water content equivalent to the water content (humidity) in the ambient condition and which is less than the water content required for sticking the film sheets to each other and the film sheet can be dried up to an optimum drying condition within a predetermined time of period.

In accordance with a third aspect of the present invention, there is provided an apparatus for drying photographic light-sensitive material such as film sheet by use of drying air in a drying chamber after the film sheet inserted into a photographic processing machine, at arbitrary intervals, has been processed in said photographic processing machine, comprising:

a first sensor means for detecting the ambient temperature around the photographic processing machine;

a second sensor means for detecting the temperature of the drying air;

a detecting means for detecting the amount of the film to be actually processed per unit time by the processing machine;

an arithmetic means for performing arithmetic operations based upon the amount of the film which can be dried within the predetermined time on the basis of the ambient temperature detected by the first sensor means and the temperature of the drying air detected by the second sensor means; and a control means for controlling the temperature of the drying air or the film inserting intervals by comparing the result of arithmetic operations of the arithmetic means with the amount of film to be actually processed.

When the film sheet is conveyed into the photographic processing machine, the amount of film to be processed is detected by the detecting means for detecting the amount of film to be processed. For example, the area of film processed may be employed as the number of film sheets, if the size of film sheets is identical. The area of film to be processed can be readily obtained as follows: the width of a film sheet is detected by sensors constituted by a plurality of light emitting units and light receiving units which are disposed in the direction of the width of the film sheet, and the time thus detected is multiplied by the length of the film obtained from the speed of conveyance thereof.

The amount of film which can be dried per unit time depends upon the ambient temperature and ambient humidity or the temperature of drying air of the processing machine. Therefore, the amount of film which can be dried per unit time is computed on the basis of the ambient condition around the machine or drying air during the period of film processing. In the present invention, the amount of film which can be dried per unit time is compared with the amount of film which is actually inserted (the totalized amount of film to be processed), to adjust the interval until the next insertion of a film sheet.

Normally, a film sheet is inserted into the processing machine at arbitrary intervals, and is conveyed to the drying chamber. However, when the totalized amount exceeds the amount of film which can be dried per unit time, the temperature in the drying chamber decreases, or the humidity therein increases. Therefore, the condition in the drying chamber becomes unsuitable for drying of film. Accordingly, in this case, by the time that the next film is introduced into the drying chamber, it is necessary to heat the interior of the drying chamber by use of warm air to achieve an appropriate environment in the drying chamber. Therefore, the intervals of successive insertions of the film sheets are prolonged by the control means.

Thus, the film sheet can be dried in an appropriate condition. Also, it is unnecessary to supply warm air at an excessive flow rate (the temperature or flow rate of warm air which corresponds to the maximum amount of film to be processed). Therefore, it is possible to reduce the capacity of the heater and hence the size of the fan.

In drying apparatus of the type which is generally used in photographic processing machine, the temperature in the drying chamber is regulated by feed-back control system at a previously set temperature. However, in a case where an amount of film or a number of film sheets continuously processed is large or where the ambient temperature around the processing machine is extremely low, even when the heater is continuously turned on, the temperature in the drying chamber may not reach the set temperature. On the other hand, if the ambient temperature around the processing machine is extremely high, the film may not be completely dried.

In the present invention, the control means may be provided with the display means. Therefore, if the condition of the drying air which can dry film reaches its lower limit, that is, if the condition of the drying air reaches any condition under which film sheet to be next inserted may be imperfectly dried, the display means displays the fact that the next film sheet can be inserted. Subsequently, when the drying condition again reaches the condition under which film can be dried, the display means displays the fact that the next film sheet can be inserted. Thereafter, an operator inserts the next film sheet in accordance with this displayed message.

Figure 4:
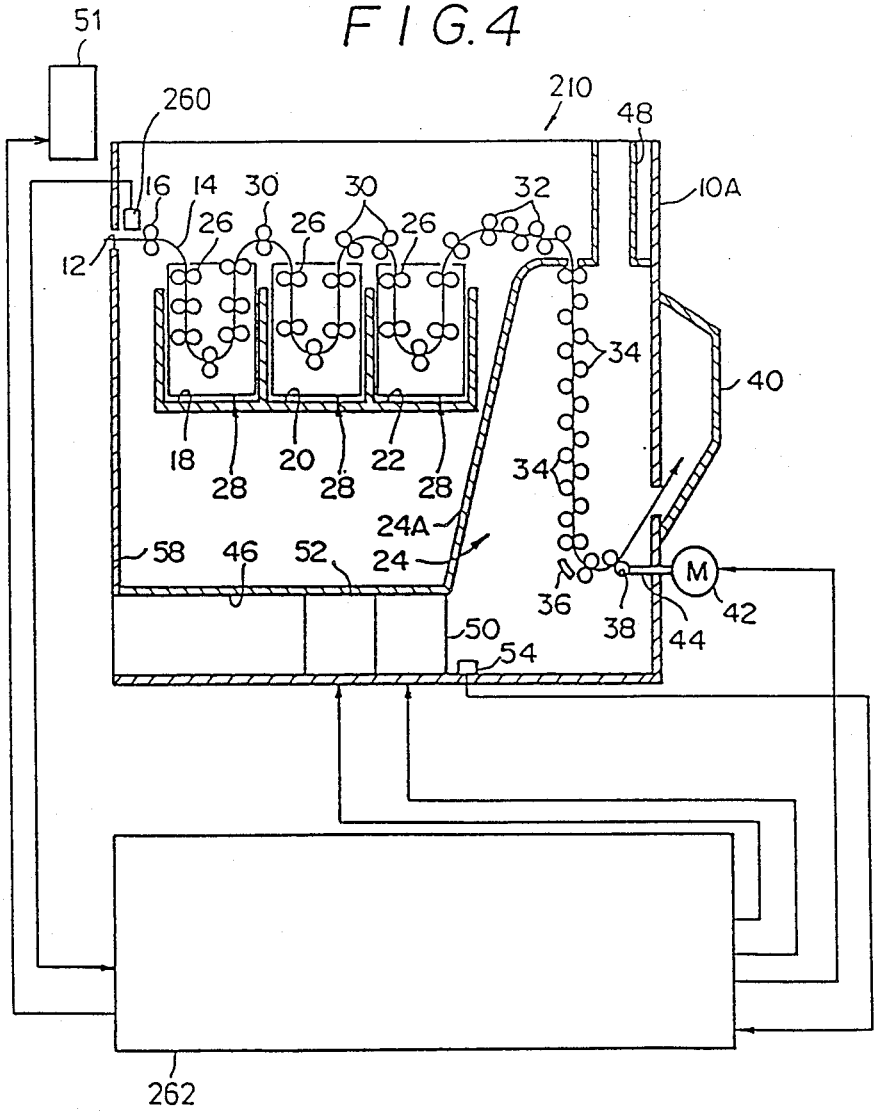
Figure 5:
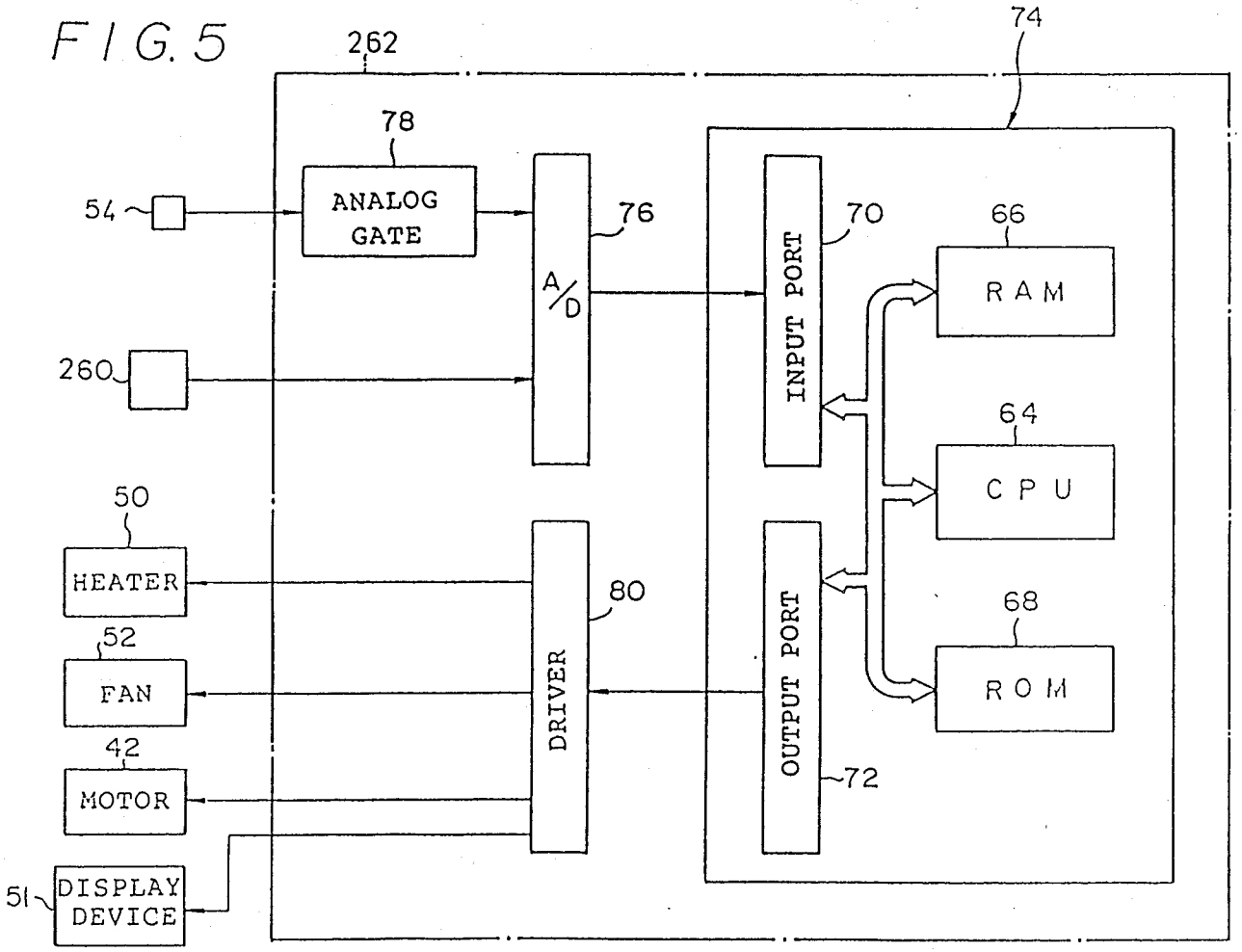
Figure 6A:
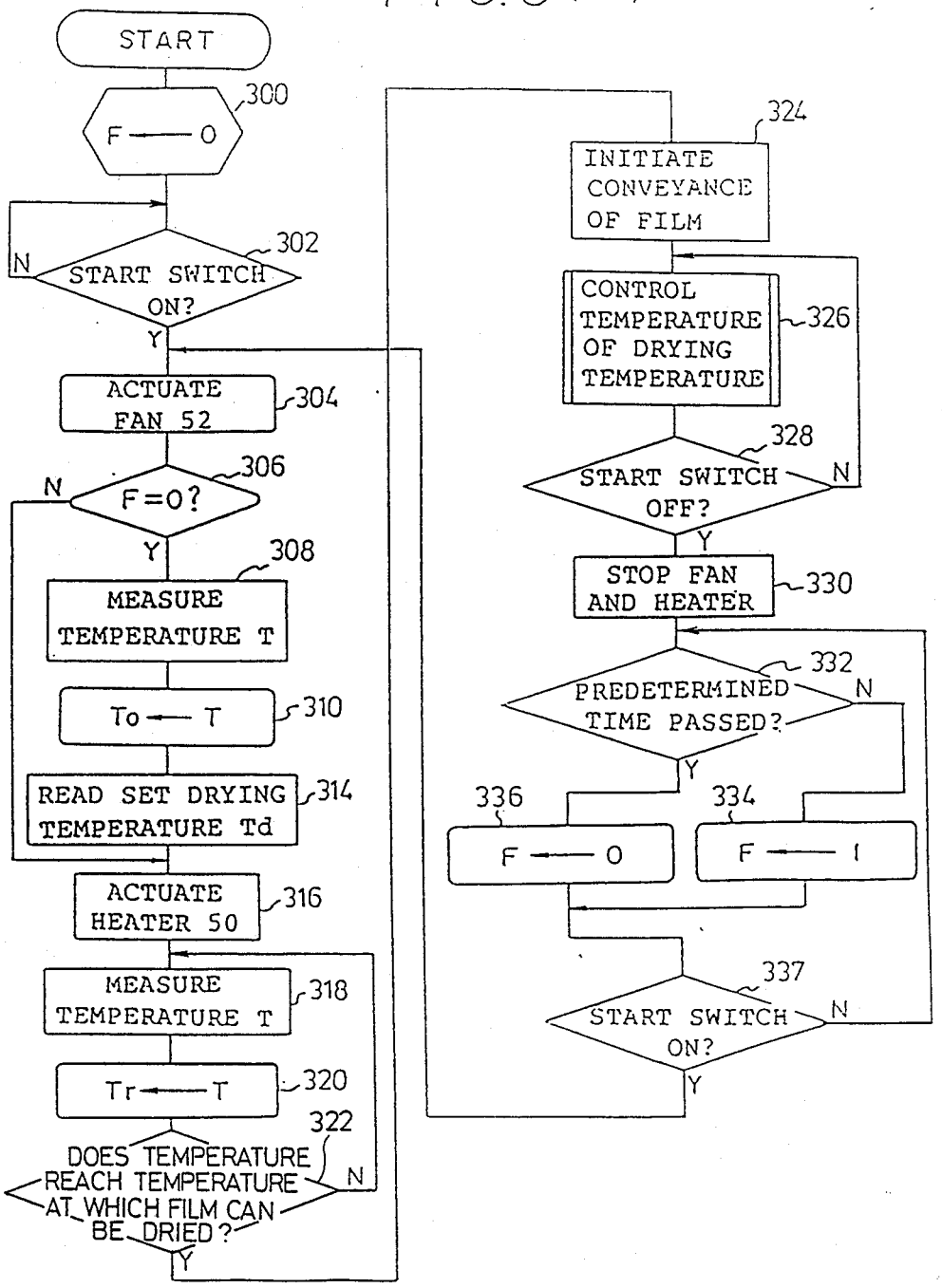
Figure 6B:
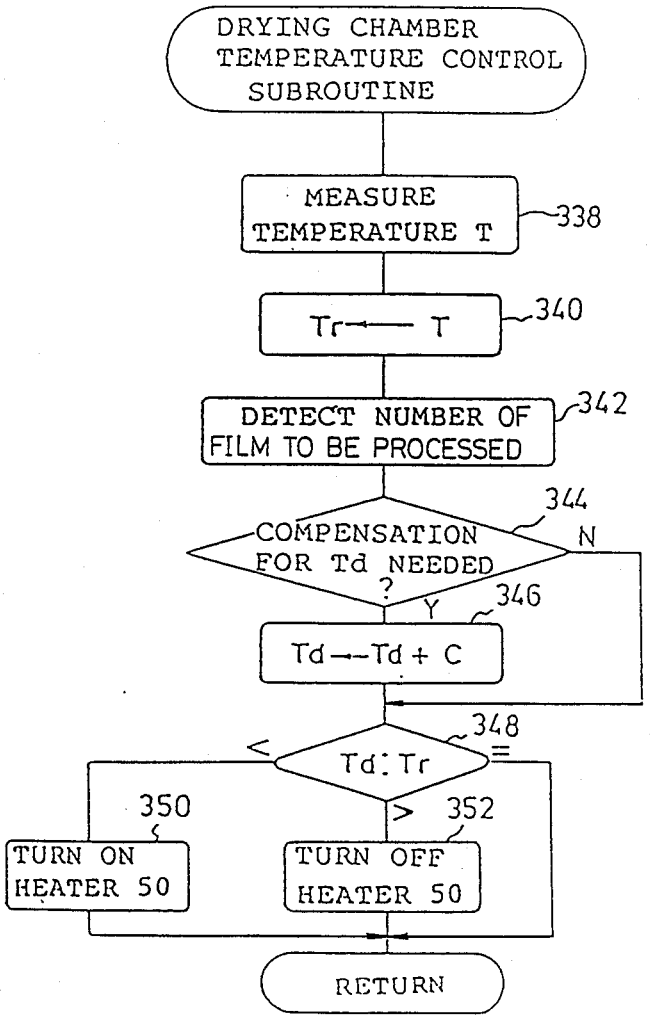
Figure 7:
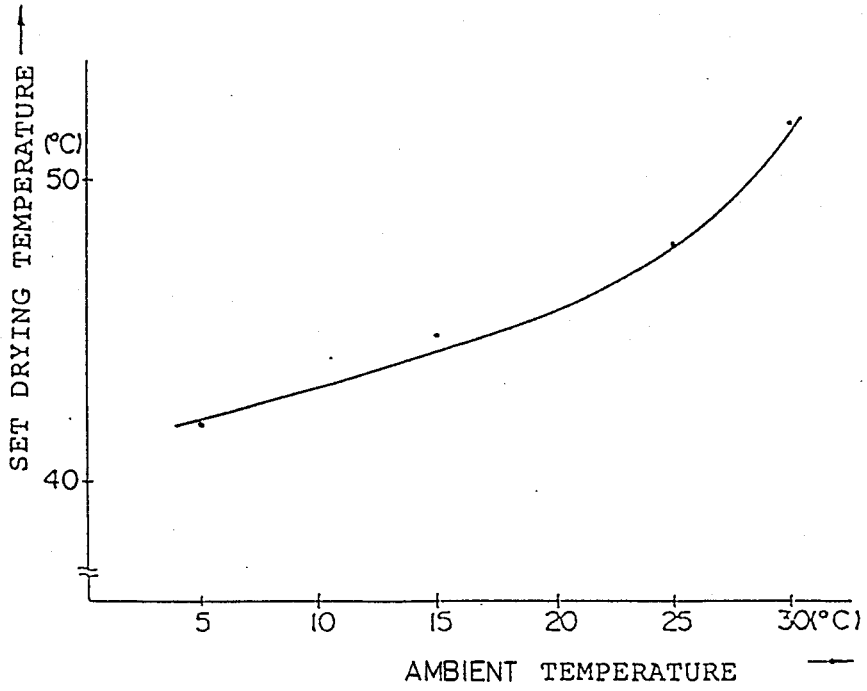
Figure 8:
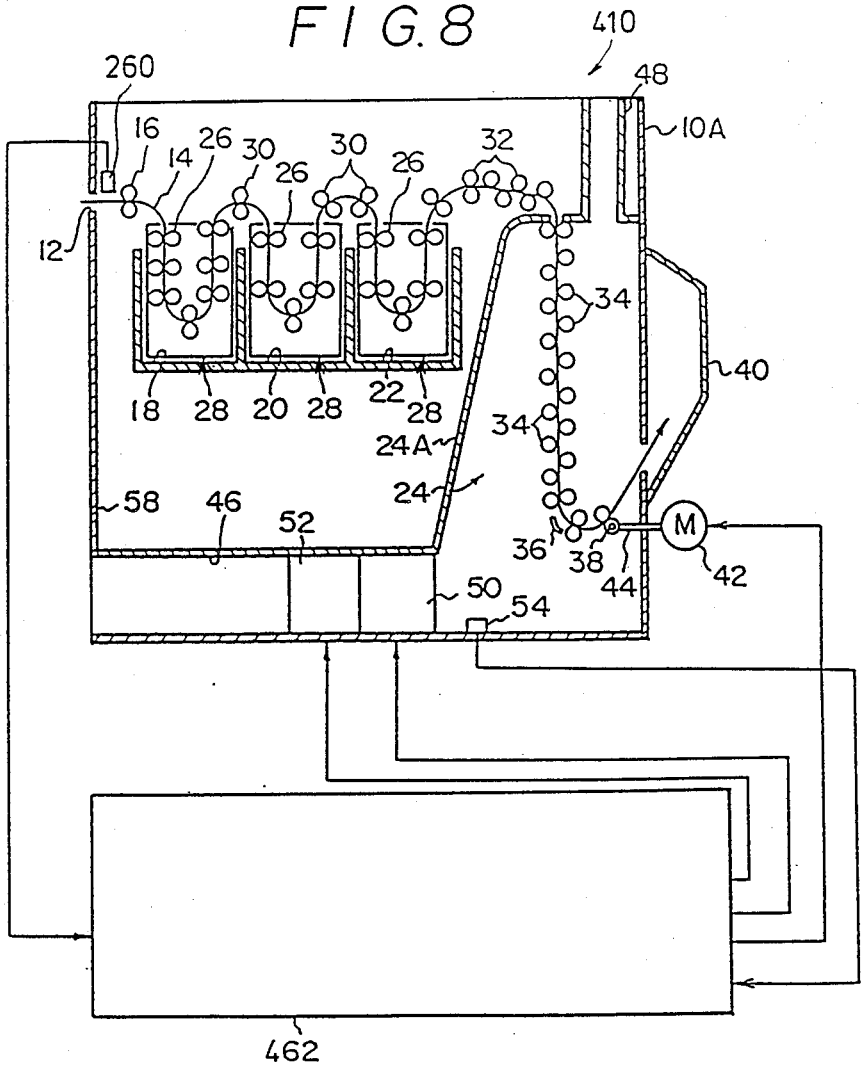
Figure 9:
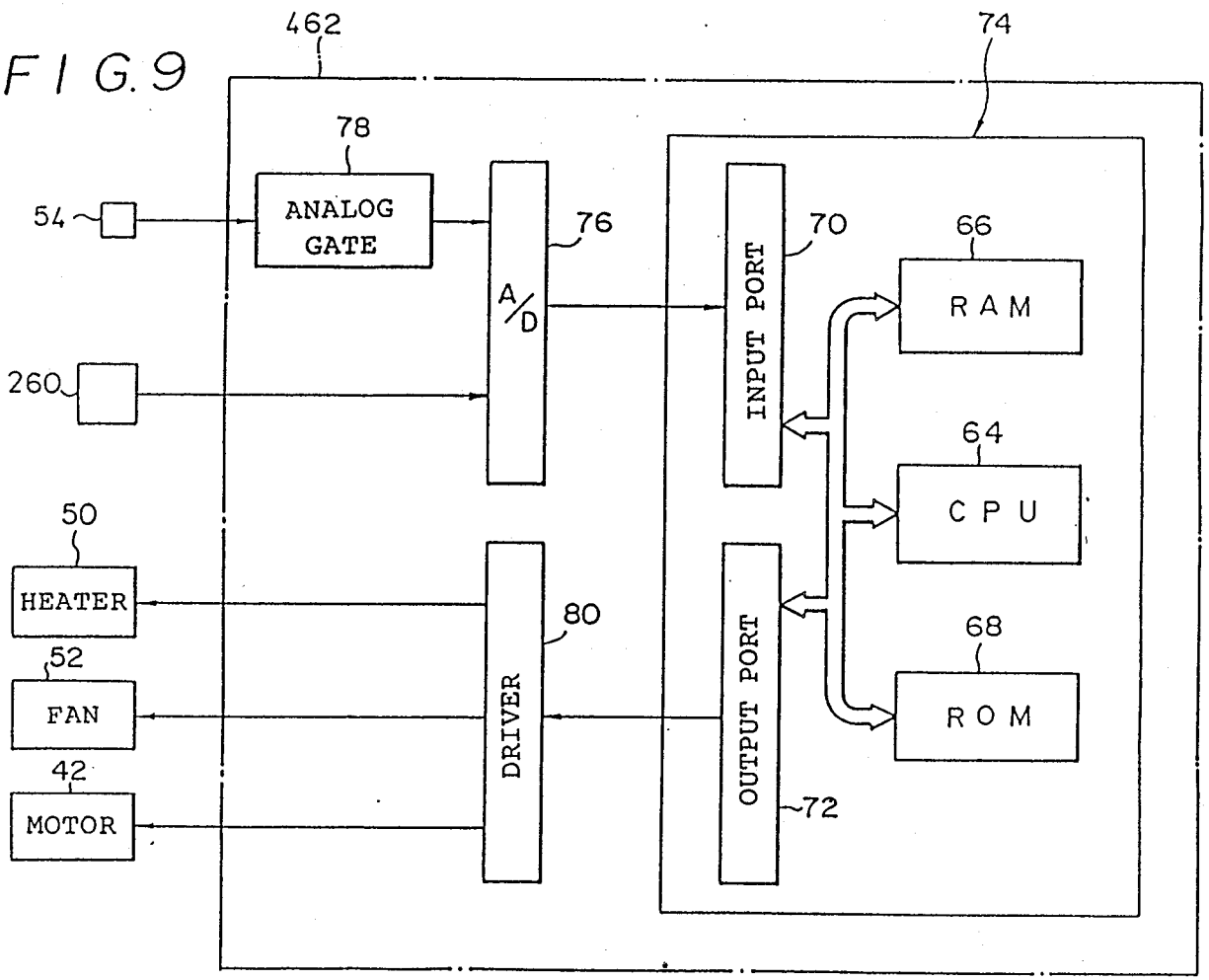
Figure 11:
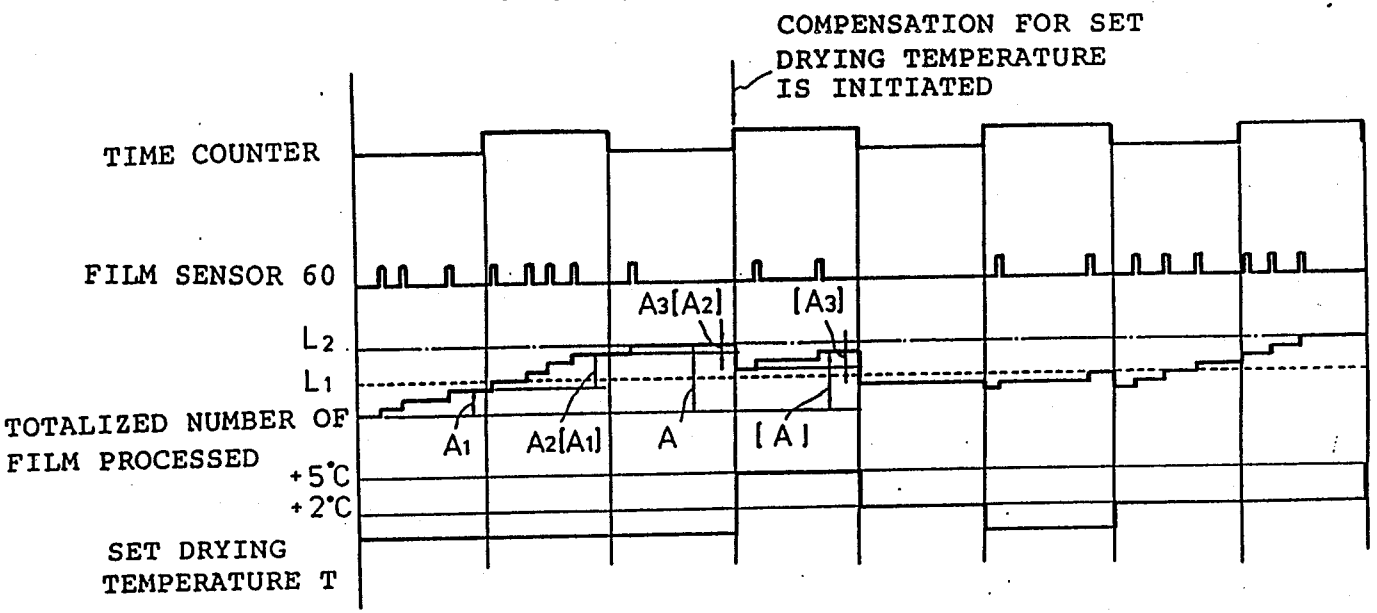
Figure 12:
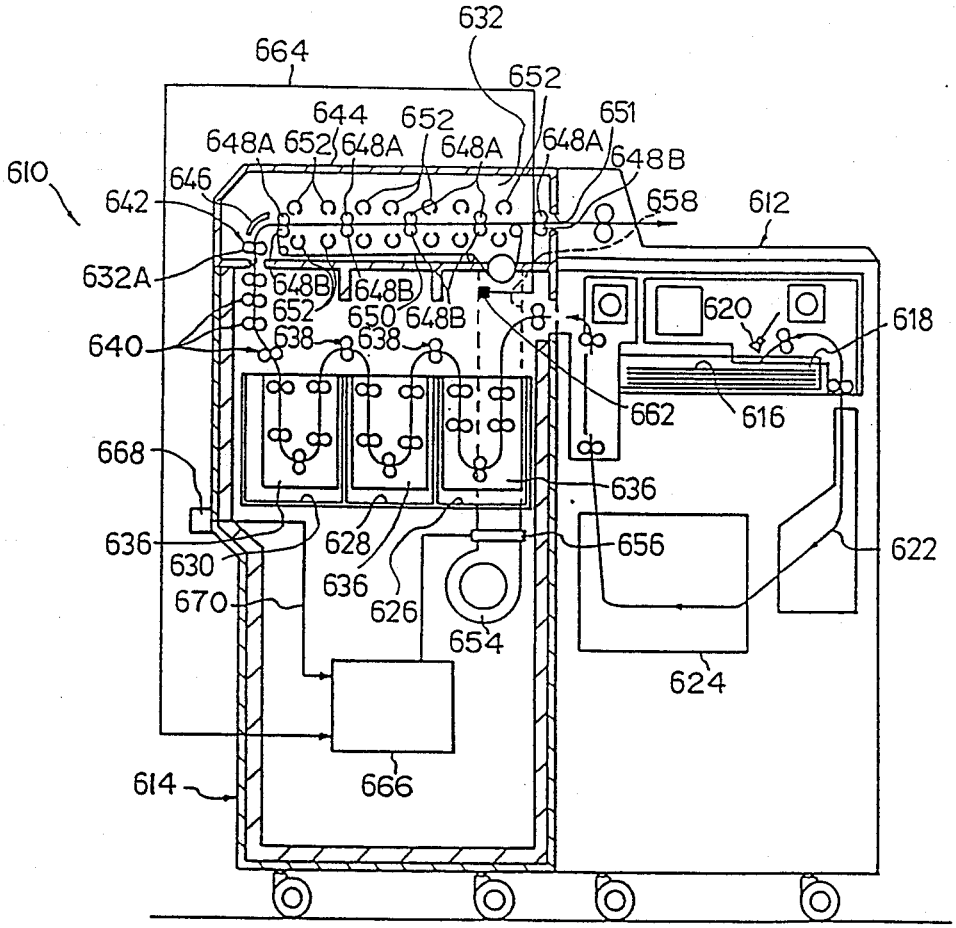
Figure 13:
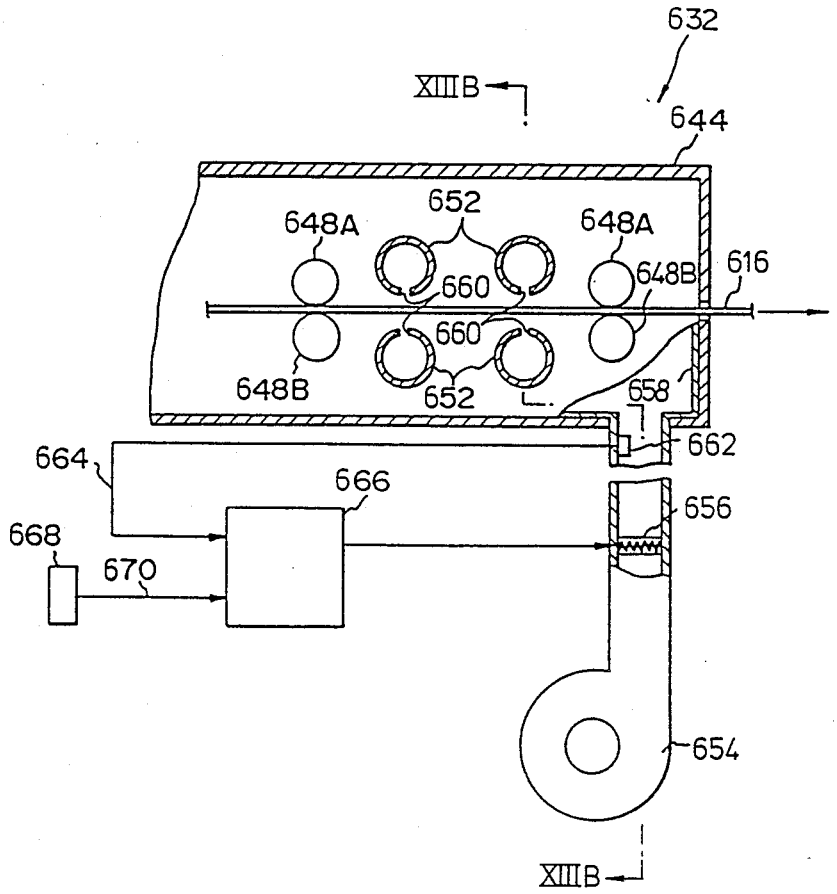
Figure 13:
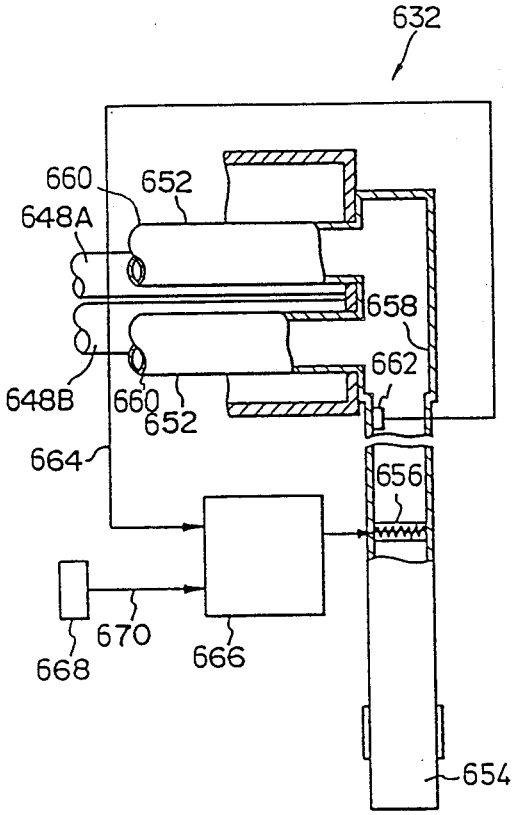
Figure 14:
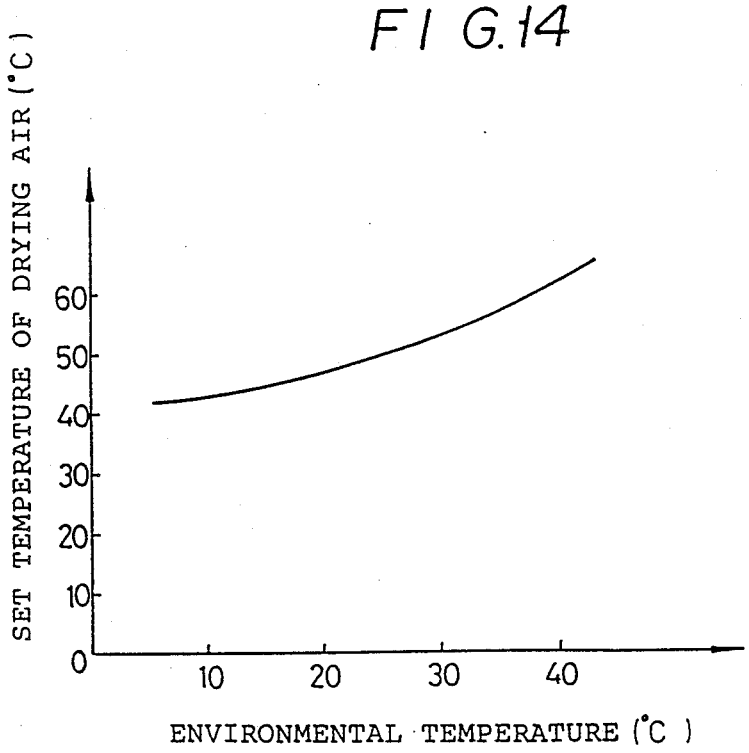
Figure 15:
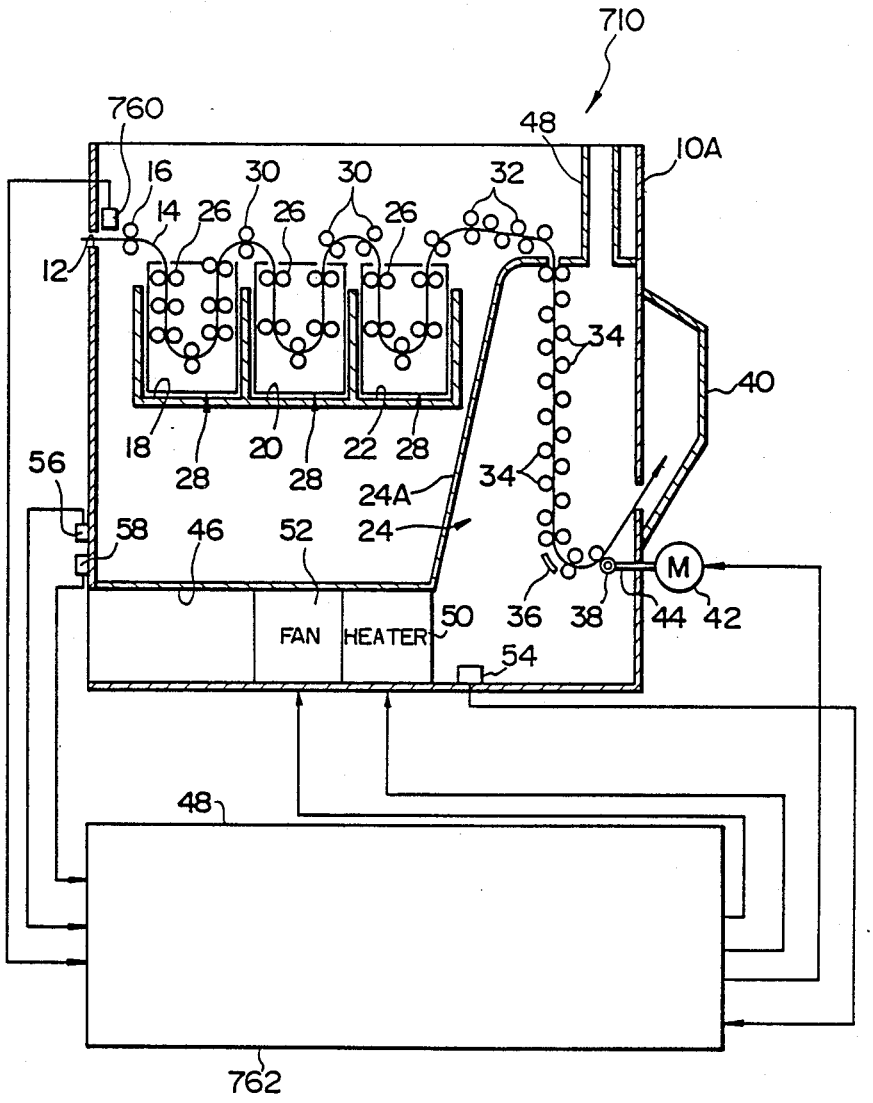
Figure 16:
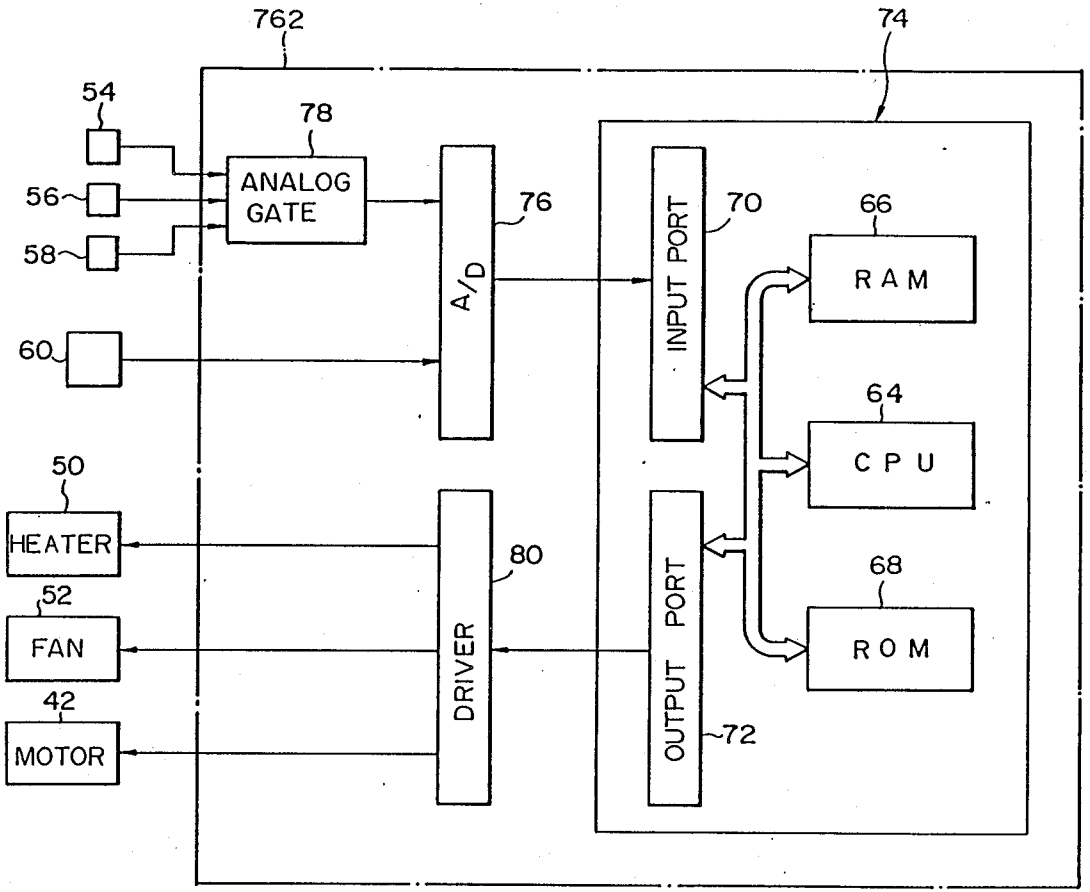
Figure 17:
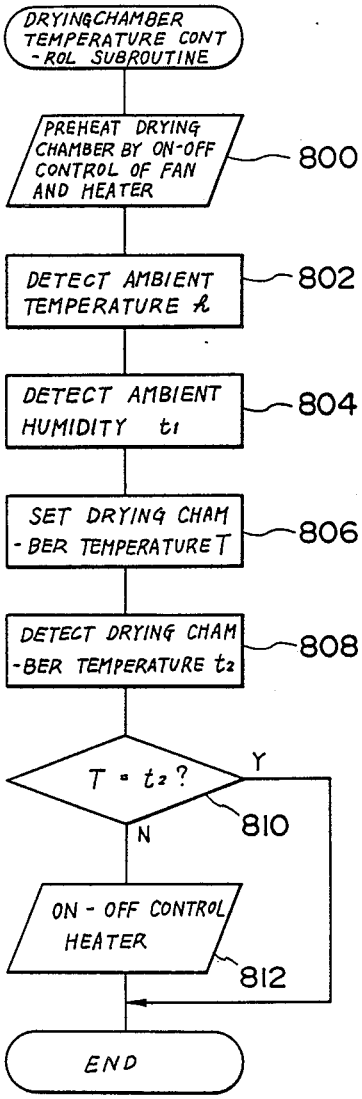
Figure 18:
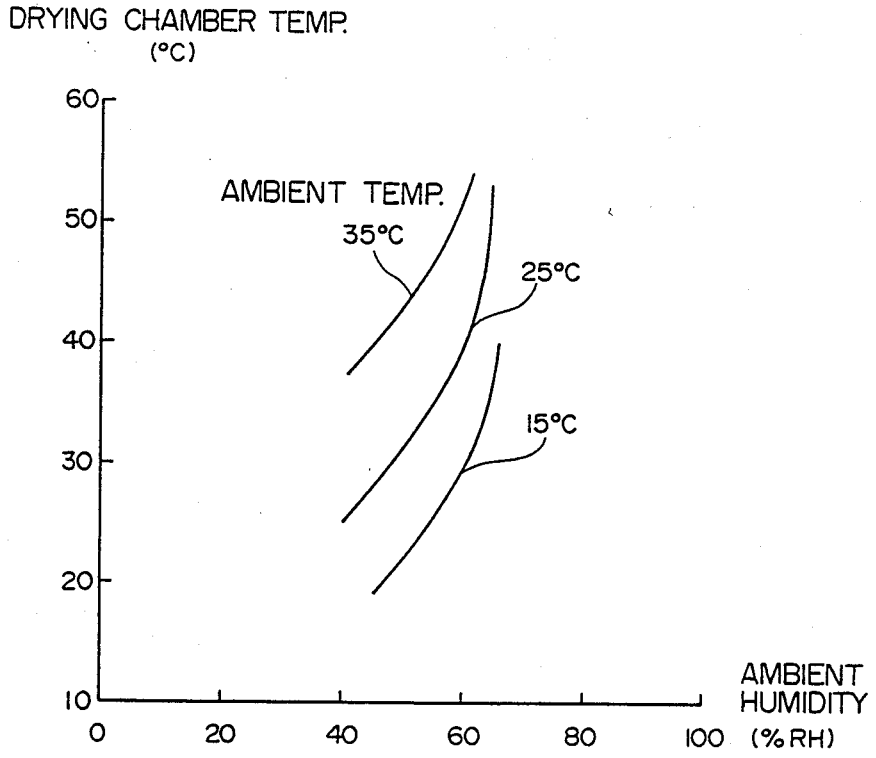
Figure 19:
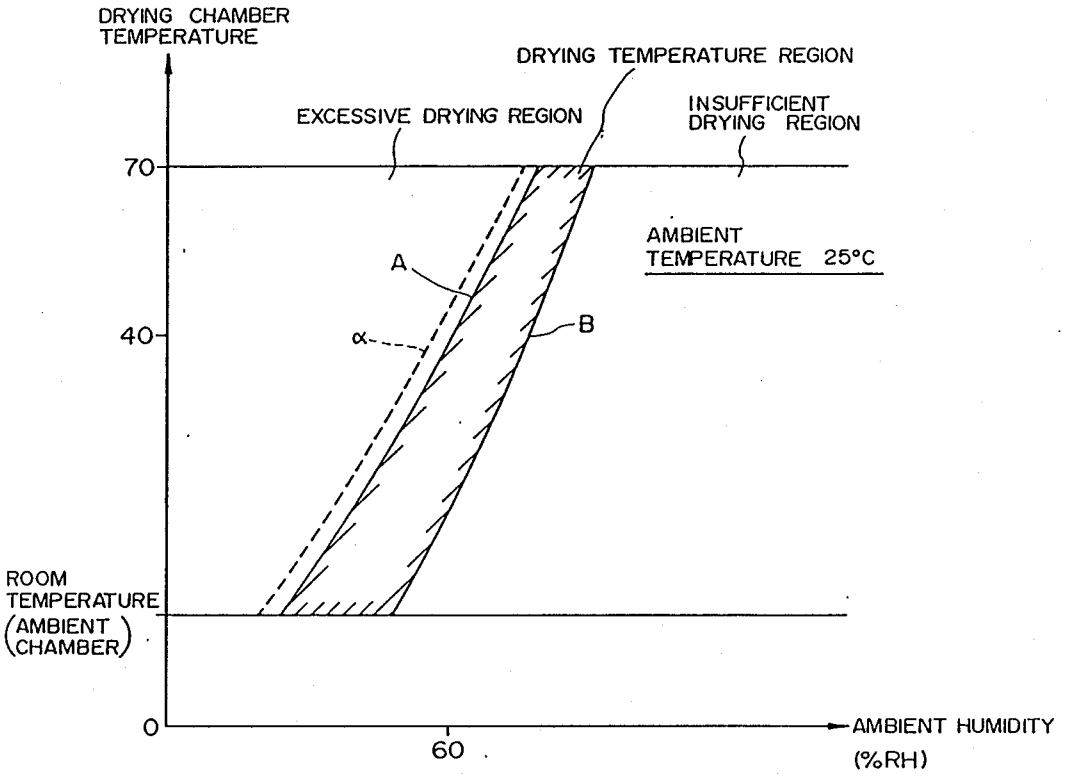
Figure 20:
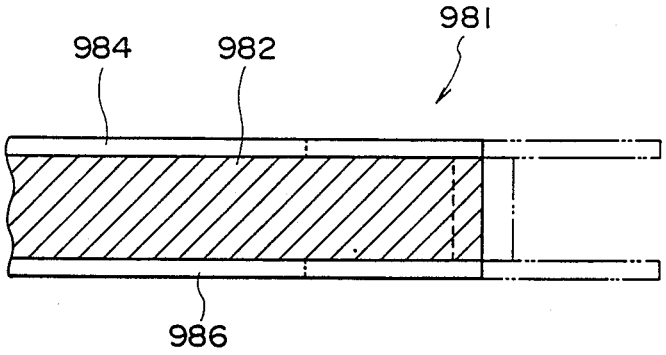

Fig, 3 is a flow chart of the control system used in the first embodiment;

FIG. 4 illustrates the diagrammatic structure of an automatic processing machine constituted by a second preferred embodiment of the present invention;

FIG. 5 is a block diagram illustrating the control system according to the second embodiment;

FIGS. 6A and 6B are flow charts of the control system according to the second embodiment;

FIG. 7 is a diagram showing predetermined drying air temperature on the vertical axis and ambient temperature horizontally;

FIG. 8 illustrates the diagrammatic structure of an automatic processing machine constituted according to a third preferred embodiment of the present invention;

FIG. 9 is a block diagram illustrating the control system according to the third embodiment;

FIGS. 10(A) and 10(B) are flow charts of the control system according to the third embodiment;

FIG. 11 is a timing chart relative to the operation of the third embodiment;

FIG. 12 illustrates the diagrammatic structure of a light-sensitive material processing machine constituted according to a fourth preferred embodiment of the present invention;

FIG. 13A diagrammatically illustrates a drying chamber and a drying system in the light-sensitive material processing machine as shown in FIG. 12;

FIG. 13B is a cross sectional view taken along the line III—III of FIG. 13A;

FIG. 14 is a characteristic chart illustrating the relationship between ambient temperature and the set temperature of drying air;

FIG. 15 illustrates the diagrammatic structure of an automatic processing machine constituted by a fifth preferred embodiment of the present invention;

FIG. 16 is a block diagram illustrating the control system of the automatic processing machine shown in FIG. 15;

FIG. 17 is a flow chart of the control system used in the fifth embodiment;

FIG. 18 is a characteristic chart illustrating optimum drying temperature curves;

FIG. 19 is a map showing a relationship between ambient humidity and temperature in drying chamber which is applied to the fifth embodiment;

FIG. 20 is a sectional view of a film; and

Figure 21:
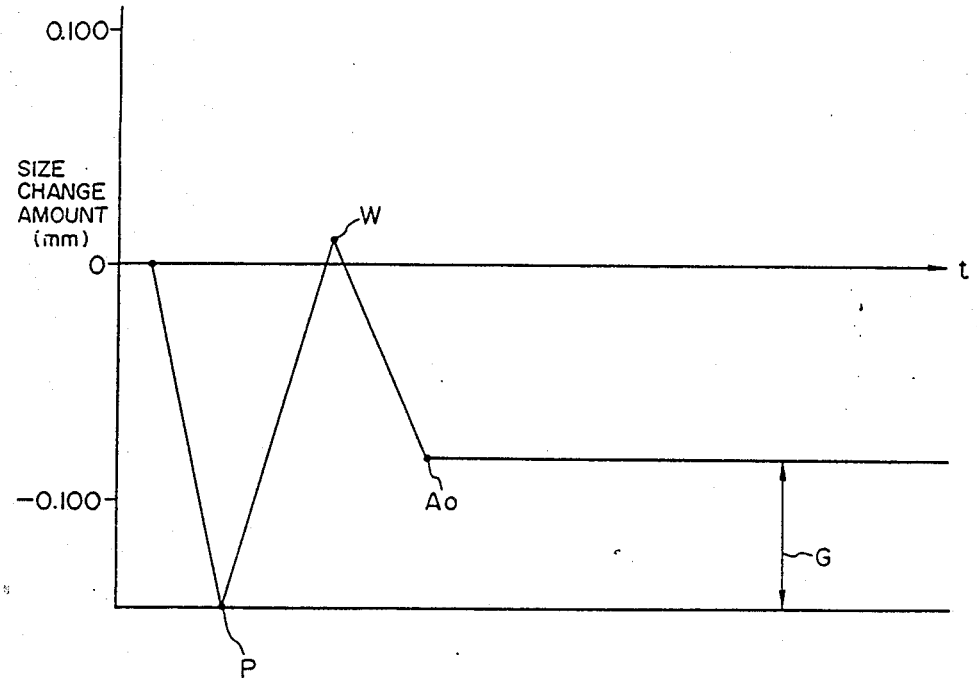

FIG. 21 is a characteristic chart showing a change of size of a film.

BRIEF DESCRIPTION OF THE PREFERRED EMBODIMENTS

Figure 1:
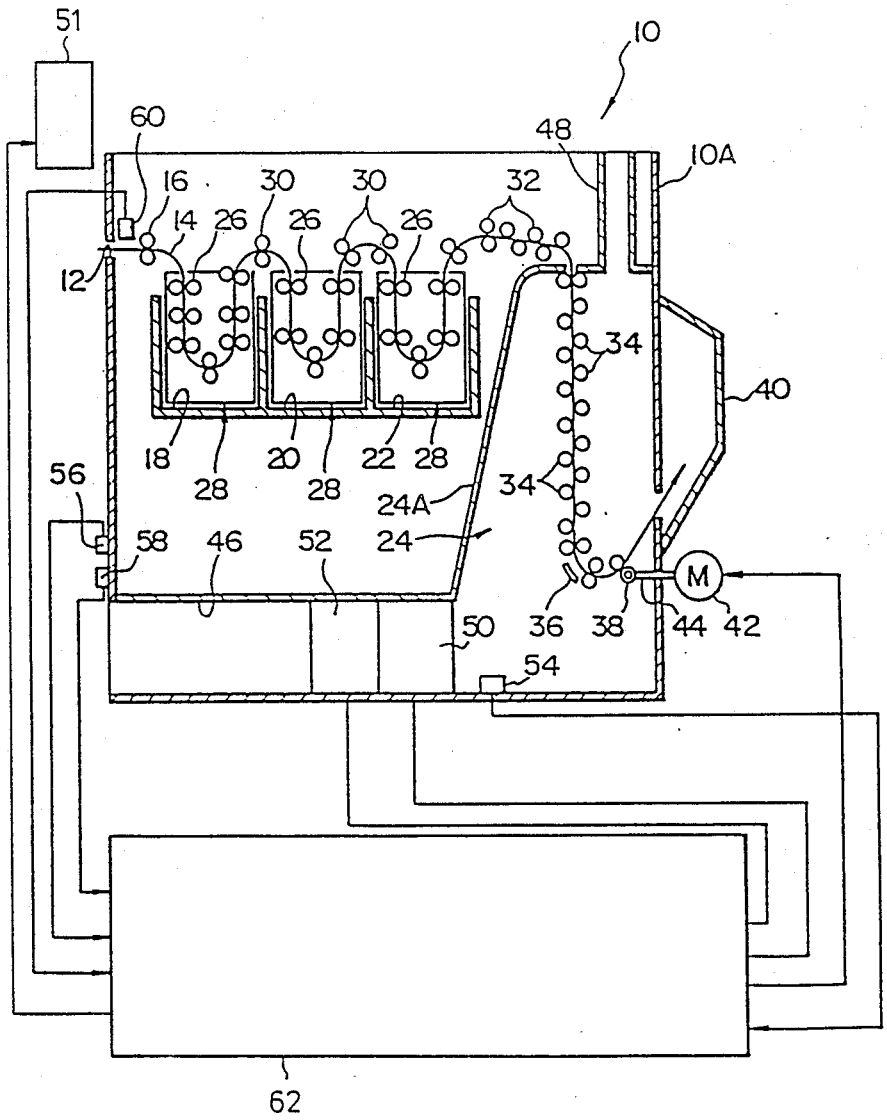
FIG. 1 illustrates the diagrammatic structure of an automatic processing machine constituted by a first preferred embodiment of the present invention.

FIG. 1 illustrates the diagrammatic structure of a first preferred embodiment of an automatic film developing machine to which the present invention is applied. In FIG. 1, 10 is an automatic film developing machine according to the first preferred embodiment of the present invention.

Film 14 is conveyed through a film inserting inlet 12 into the automatic developing machine 10. In the interior of the automatic developing machine 10, the film 14 is guided by guide rollers 16, passed through a developing bath 18, a fixing bath 20 and a washing bath 22, and conveyed into a drying chamber 24. Racks 28 each having a plurality of guide rollers 26 are placed in the developing bath 18, the fixing bath 20, and the washing bath 22, respectively. In each of the baths, the film 14 is conveyed downwardly from the liquid surface to the bottom by means of the guide rollers 26 of the racks 28. After the film 14 is returned upwardly at the bottom of the each bath to be conveyed toward the liquid surface. In this manner, the film 14 is immersed in the respective baths and conveyed by the rollers 16 of the racks 28.

As illustrated, a plurality of guide rollers 30 are disposed above the boundary between the developing bath 18 and the fixing bath 20 as well as the boundary between the fixing bath 18 and the washing bath 22. Therefore, the film 14 is guided by the guide rollers 30 from each bath to the adjacent one. A plurality of rollers 32 are disposed between the washing bath 22 and the drying chamber 24 so as to guide the film 14 into the drying chamber 24. It is to be noted that an additional function of these rollers 32 is to squeeze the film 14 to wipe off water, at least in part, remaining on the surfaces of the film 14.

In the drying chamber 24, a plurality of conveying rollers 34 are disposed in such a manner that the rollers 34 are vertically equally spaced each other as viewed in FIG. 1. Therefore, the film 14 is conveyed substantially straight from the top of the drying chamber 24 to the bottom by the conveying force given by the rotation of the conveying rollers 34. A guide plate 36 is disposed at a lower portion of the drying chamber 24 so as to turn the film 14 toward a right-hand wall (as viewed in FIG. 1) of a frame 10A of the developing machine 10. The film 14, in turn, is conveyed by the conveying force of a drive roller 38 into a film receiving box 40 attached to an outer wall of the frame 10A.

The drive roller 38 is linked with a motor 42 through a belt 44, and the drive roller 38 is rotated through that belt 44 by the drive force of the motor 42 through the belt. It is noted that the rollers disposed in the automatic developing machine 10 are linked to the drive roller 38 through chain means, belt means or geared transmission (neither of which is shown) so that all the rollers may be rotated at the same time.

An intake duct 46 and a discharge duct 48 are connected to portions of a partition wall 24A of the drying chamber 24, thereby providing communication between the exterior and the drying chamber 24. A heater 50 is connected to the intake duct 46 through a fan 52. The outside air is introduced into the intake duct 46 by the rotation of the fan 52, and in turn is heated by the heater 50. Thereafter, the warm air thus produced is supplied to the drying chamber 24. The film 14 and the conveying rollers 34 are dried by the warm air, and the resultant wet air is discharged through the discharge duct 48 from the automatic developing machine 10.

The automatic developing machine 10 is provided with a main power switch as well as a start switch (not shown) for actuating the motor 42, the heater 50 and the fan 52. The motor 42, the heater 50 and the fan 52 can be actuated by turning on the respective start switch.

A temperature detecting sensor 54 is disposed in the drying chamber 24 for detection of the temperature of the drying air. A sensor 56 for detecting the temperature of the outside air and a sensor 58 for detecting the humidity of the outside air are disposed on a portion of the outer wall of the automatic developing machine 10. Further, a plurality of film detecting sensors 60 (one of which is shown) are disposed in the vicinity of the film inserting inlet 12 across the width of the film 14 so as to detect the amount of film 14 to be processed, that is, a unit area Su of the film 14 inserted into the automatic developing machine 10.

The drying air temperature detecting sensor 54, the outside air (ambient) temperature detecting sensor 56, the outside air (ambient) humidity detecting sensor 58, and the film detecting sensors 60 are connected to a control device 62.

Figure 2:
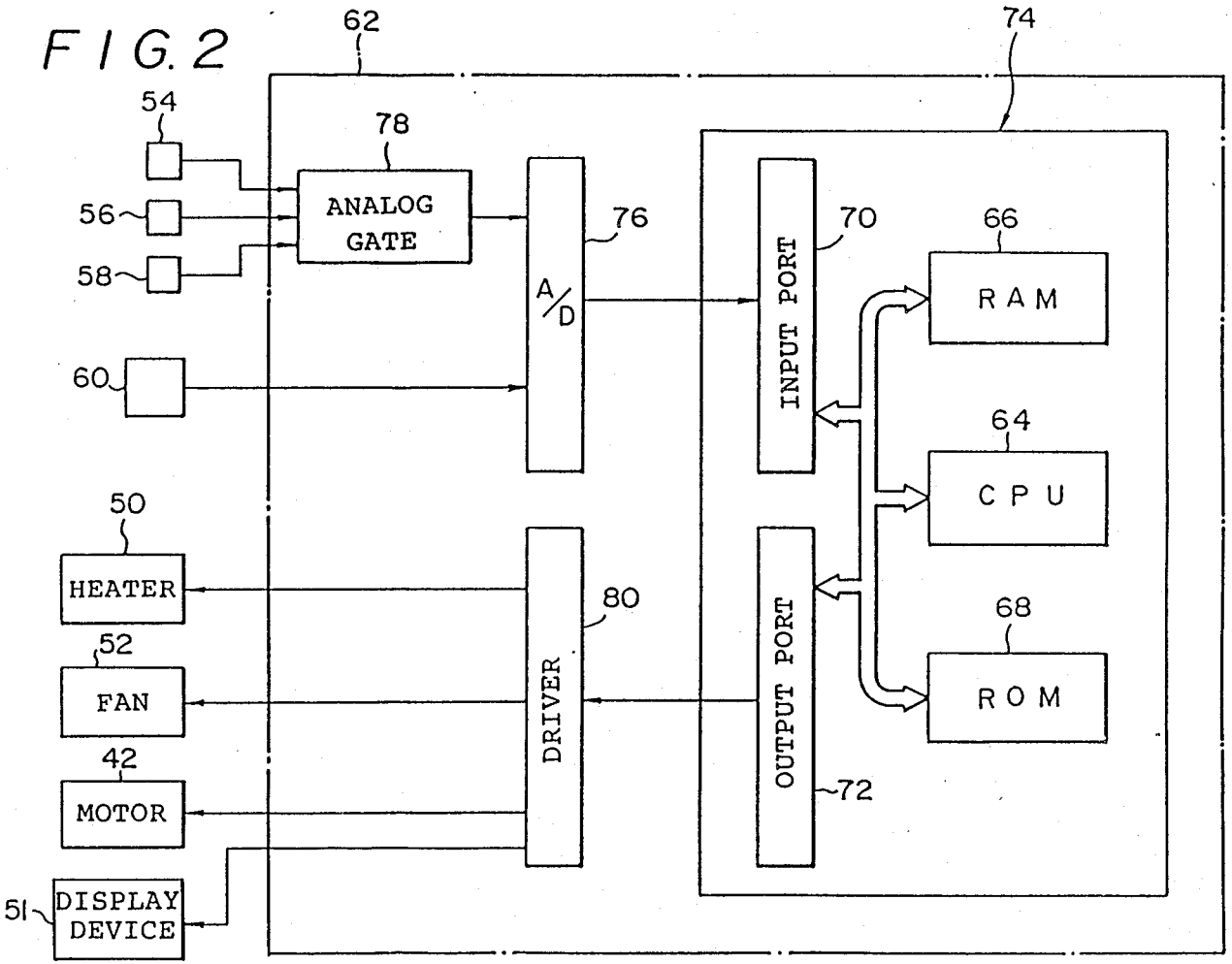
FIG. 2 is a block diagram illustrating the control system of the automatic processing machine shown in FIG. 1.

As shown in FIG. 2, the control device 62 includes a microcomputer constituted by a CPU 64, a RAM 66, a ROM 68, an input port 70 and an output port 72, an A/D converter 76, an analog gate 78, and a driver 80.

The drying air temperature detecting sensor 54, the outside air temperature detecting sensor 56, and the outside air humidity detecting sensor 58 are connected to the corresponding inputs of the analog gate 78. The output signals of the analog gate 78 are supplied through the A/D converter 76 to the input terminal of the input port 70 of the microcomputer 74. The film detecting sensor 60 is connected through the A/D converter 76 to the input port 70.

The motor 42, the heater 50 and the fan 52 as well as a display device 51 are connected to the corresponding output terminals of the driver 80, and are driven by control signals from the output port 72.

Based on the arithmetic expressions stored in advance in the ROM 68, the CPU 64 of the microcomputer 74 computes an area S of the film 14 that can be processed per unit time from the values obtained by the drying air temperature detecting sensor 54, the ambient temperature detecting sensor 56, and the ambient humidity detecting sensor 58.

$$S = f\{Td, To, H\}$$

where

Td: temperature of the drying air,

To: ambient temperature, and

H: ambient humidity.

Each unit area Su of the inserted film 14 which is obtained by the film detecting sensor 60 is added up in sequence by the CPU 64. The totalized area St of the unit areas Su is stored in the RAM 66.

Figure 3:
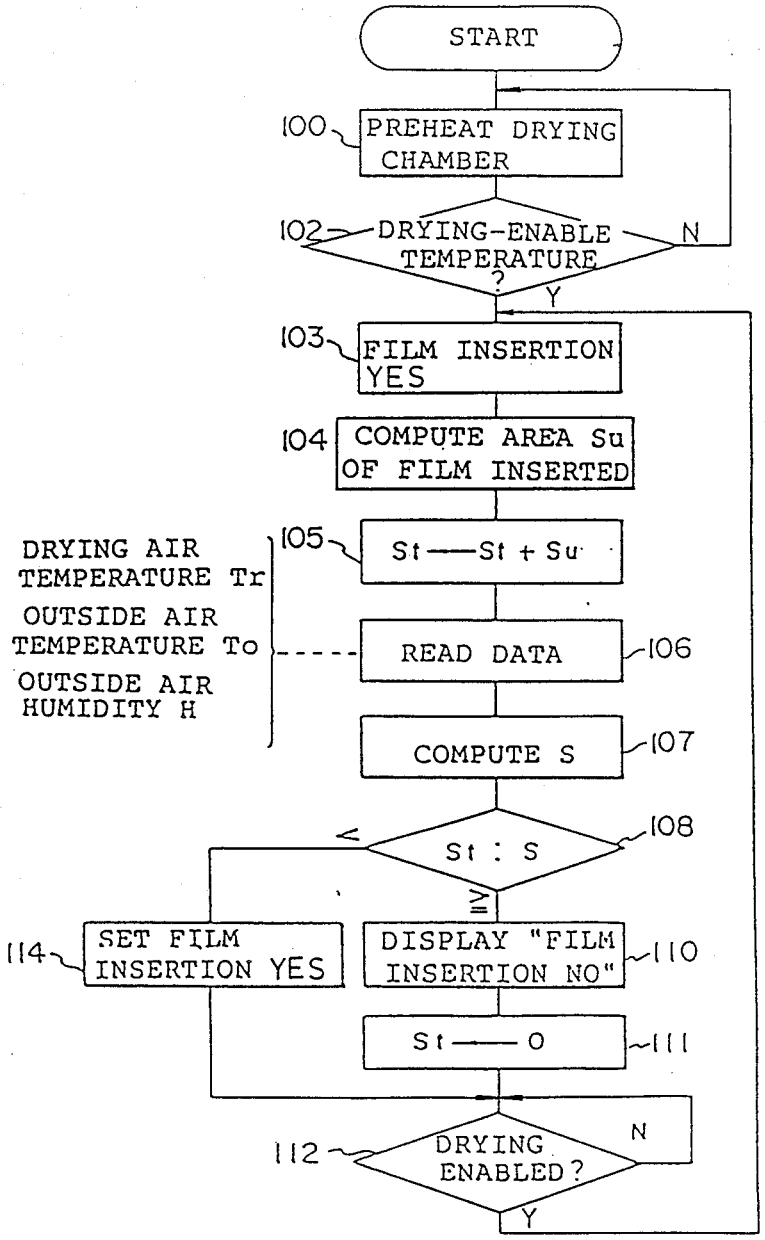

The following is a description of the operation of the first embodiment with reference to the flow chart of FIG. 3.

When the power switch (not shown) of the automatic developing machine 10 is turned on, a program is started. When the automatic developing machine 10 is stopped, the data stored in the RAM 66 of the microcomputer 74 is reset. In Step 100, the heater 50 and the fan 52 are operated under on-off control to preheat the drying chamber 24 up to a temperature at which the film can be dried. The temperature of the drying air can be readily controlled by comparing the the value of a previously set temperature with the signals of the temperature of the drying air supplied from the drying air temperature detecting sensor 54 to the control device 62. In Step 102, judgement is made with respect to whether or not the temperature of the drying air reaches a temperature at which the film can be dried. If negative judgement is made, the process returns to Step 100, in which on-off control over the heater 50 or the fan 52 is continued. The heater 50 cannot be operated unless the fan 52 is operated.

If affirmative judgement is made in Step 102, the process proceeds to Step 103, in which the display device 51 is made to display "FILM INSERTION YES" (meaning that the machine 10 is ready for inserting the film 14). Thus, the film 14 is inserted into the automatic developing machine 10. After the film 14 has been passed through the film inserting inlet 12, it is guided by the guide rollers 16 and is passed through the developing bath 18, the fixing bath 20 and the washing bath 22.

In each of the baths, the film 14 is subjected to respective processes. The film 14 is guided into each of the baths by the guide rollers 26 which are supported by the respective racks 28. Therefore, since the film 14 is immersed deeply in the respective baths, it is possible to assure a predetermined processing time. After the film 14 has left the washing bath 22, it is conveyed to the drying chamber 24 by a plurality of the rollers 32. The plurality of rollers 32 squeeze the film 14 to wipe off water remaining on the surfaces of the film 14. Therefore, the time required for drying the film is shortened.

In Steps 104 and 105, signals detected by the film detecting sensor 60 is supplied to the microcomputer 74 to read data each time a predetermined period since the film 14 has been passed through the film inserting inlet 12. The unit area Su of the film 14 is obtained by arithmetic operations based upon the detected signals in the microcomputer 74. The unit area Su thus obtained is temporarily stored in the RAM 66 in the form of the totalized area St (the totalized area of the film to be processed of the unit areas Su). At the time of the next data reading, the addition of the newly obtained unit area Su and the totalized area St is executed, and the result is restored as ($St \leftarrow St + Su$).

After the totalized area St of the film 14 is computed in Step 105, the process proceeds to Step 106, in which data detected by each of the drying air temperature detecting sensor 54, the ambient temperature detecting sensor 56 and the ambient humidity detecting sensor 58 is read into the microcomputer 74 through the analog gate 78 and the A/D converter 76. In Step 107, arithmetic operations are performed upon an area S of the film 14 which can be dried per unit time in the drying chamber 24. In Step 108, the aforesaid totalized area St is compared with this area S that can be dried.

If the totalized area St reaches the area S of the film that can be dried, that is, if $St \geqq S$, the process proceeds to Step 110, in which the display device 51 is made to display "FILM INSERTION NO" (meaning that the machine 10 is not ready for insertion of further film). During this time interval, the drying chamber 24 is heated, and thus the temperature and humidity in the drying chamber 24 can be restored to the condition at which further film can be dried, whereby the occurrence of imperfect drying is prevented. After the intervals between successive insertions of the film sheets have been determined in Step 110, the area St is reset in Step 111. In Step 112, the process is maintained in a standby state for an interval during which the film 14 can be dried again, and returns to Step 103.

If the totalized area St does not reach the area S of the film which can be dried in the drying chamber 24 per unit time, that is, if $St < S$, the process proceeds to Step 114, in which arbitrary intervals are read out of the ROM 68. The process proceeds to Step 112.

As described above, in the first embodiment, the intervals between successive insertions of the film 14 are modified by comparing the area St of the film 14 which has actually been introduced to the machine 10 and the area S of the film 14 which can be dried in the drying chamber 24. Therefore, the wet film 14 is prevented from reaching the film receiving box 40, and the film 14 can be properly dried in the drying chamber 24. Also, it is unnecessary to employ the fan 52 or the heater 50 which allows for a large capacity of film processing, and, since adjustment is made by modifying the intervals between successive insertions of the film 14, the fan 52 and heater 50 having small size and configuration can be selected. Therefore, the size of the machine 10 itself can be reduced as required, and this leads to a reduction in the production cost.

It is to be noted that, in the first embodiment, the measured temperature of the drying air is employed as part of data used for computing the area which can be dried. However, the set temperature of drying air which is stored in advance in the ROM 68 may be used.

Also, the temperature at which the film can be dried in the drying chamber 24 (in Step 102) is not limited to the set temperature of the drying air, and may be selected within a certain temperature range. More specifically, if the automatic developing machine 10 is restarted after it has been stopped for a short period of time, the temperature of the drying air may not reach the set temperature soon. In this case, if the film 14 is immediately introduced into the machine 10, the film 14 can be dried by retained heat.

FIG. 4 illustrates the diagrammatic structure of a second preferred embodiment of an automatic developing machine to which the present invention is applied. In FIG. 4, the automatic developing machine is indicated generally at 210. In the second embodiment, like reference numerals are used to denote like or corresponding elements relative to those of the first embodiment, and the description thereof is omitted for the sake of simplicity.

The second embodiment differs from the first embodiment in that, although the temperature detecting sensor 54 is disposed in the drying chamber 24, the ambient temperature detecting sensor 56 and the ambient humidity detecting sensor 58 are omitted which are both employed in the first embodiment. More specifically, in the second embodiment, the temperature detecting sensor 54 is also applied to the detection of the ambient temperature. A film detecting sensor 260 of the second embodiment is constituted by a photoelectric sensor, and the optical axis of light which emanates from a light emitting element of that sensor to a light receiving element of the same is disposed on the path along which the film 14 is inserted. Therefore, the photoelectric sensor is turned on and off in response to the introduction of the film 14 to be processed.

The output signals of the film detecting sensor 260 and the temperature detecting sensor 54 are supplied to corresponding input terminals of a control device 262.

As shown in FIG. 5, the control device 262 includes the microcomputer 74 constituted by the CPU 64, the RAM 66, the ROM 68, the input port 70 and the output port 72, the A/D converter 76, the analog gate 78, and the driver 80.

The temperature detecting sensor 54 is connected through the analog gate 78 to the A/D converter 76 whose output signals in turn are supplied to the input port 70. The film detecting sensor 260 is connected through the A/D converter 76 to the input terminal of the input port 70 of the microcomputer 74.

The motor 42, the heater 50, the fan 52, and the display device 51 are connected to the corresponding output terminals of the driver 80, and are driven by control signals from the output port 72.

The CPU 64 of the microcomputer 74 performs arithmetic operations upon the number of film sheets or the area thereof which are obtained by the film detecting sensor 260 in each predetermined time, and the result is stored in the RAM 66. A set temperature Td of drying air which will be described later is adjusted in accordance with this number of film sheets or the area of film to be processed. Also, the ROM 68 stores a map representative of the relationship between that ambient temperature To and the set temperature Td of the drying air within the drying chamber 24 (refer to FIG. 7). Upon the detection of the ambient temperature, the set drying temperature Td within the drying chamber 24 is computed in accordance with the ambient temperature To. In addition, the ROM 68 stores a predetermined time which is to be compared with a time which elapses since the stoppage of the automatic developing machine 210.

The remaining construction of the second embodiment is the same as that of the first embodiment.

The operation of the second embodiment will be described below with reference to the flow charts shown in FIGS. 6A and 6B.

In Step 300 a flag F is reset, and the process proceeds to Step 302. In Step 302, judgement is made with respect to whether or not a start switch (not shown) of the machine 210 is turned on. If the start switch is OFF, the above operations are repeated. If the start switch is turned on, the process proceeds to Step 304, in which the fan 52 is operated, and then judgement is made in Step 306 with respect to the state of the flag F. If the flag F is reset (F=0), the process proceeds to Step 308 in which the temperature T is detected by the temperature detecting sensor 54. In this case, since the heater 50 is not operated, the temperature of the ambient air supplied by the operation of the fan 52 is equal to the ambient temperature of the ambient air around the automatic developing machine 210. Therefore, in the following Step 310, the ambient temperature To is substituted for the temperature T, and the process proceeds to Step 314.

In Step 314, the set drying temperature Td is read on the basis of the map shown in FIG. 7. When the set drying temperature Td is determined, the process proceeds to Step 316 in which the heater 50 is operated. It is to be noted that if the flag F is set (F=1) in Step 306, the operations in Steps 308 through 314 are omitted, and the process jumps to Step 316 in which the heater 50 is operated. The conditions later for setting the flag F will be explained in the description of the operations in Steps 332 through 337.

When the heater 50 is operated in Step 316, the process proceeds to Step 318 in which the temperature detecting sensor 54 is made to detect the temperature T. Since the temperature detecting sensor 54 is disposed downstream of the heater 50, the temperature detected at this position is equal to the temperature Tr of warm air supplied to the drying chamber 24. Therefore, the detected temperature T is substituted for the temperature Tr of the warm air. The warm air at this detected temperature Tr is supplied through the intake duct 46 to the drying chamber 24.

In the following Step 322, judgement is made with respect to whether or not the temperature Tr of the drying air reaches a temperature at which the film can be dried. The temperature at which the film can be dried is a temperature within a predetermined temperature range near the set temperature of the drying air. Unless the former temperature reaches this temperature range, Steps 318 and 320 are repeated. When the temperature T (Tr) detected by the temperature detecting sensor reaches the predetermined temperature range, the process proceeds from Step 322 to Step 324, in which the display device 51 is made to display "FILM INSERTION YES" meaning that the machine 210 is ready for insertion of the film. The film sheet 14 inserted is subjected to developing, fixing, and washing, introduced to the drying chamber 24 in which the film is dried, and stored in the film receiving box 40. Then, the temperature of the drying air is controlled in Step 326. This temperature control will be described in detail with reference to the temperature control subroutine of FIG. 6B which will be mentioned later.

In Step 328, judgement is made as to whether or not the start switch is OFF. When the start switch is ON, Steps 326 and 328 are repeated to continue developing and drying as well as temperature control. When the start switch is turned off, the process proceeds to Step 330, in which the operations of the fan 50 and the heater 52 are stopped. In Step 332, judgement is made with respect to whether or not the time which elapses since the stoppage of the fan 50 and the heater 52 has reached a predetermined time which is stored in advance in the ROM 68. Unless the predetermined time has elapsed, the process proceeds to Step 334 in which the flag F is set, and then proceeds to Step 337. If the predetermined time has elapsed, the flag F is reset, and then the process proceeds to Step 337. In Step 337, judgement is made with respect to whether or not the start switch is turned on, that is, whether or not the automatic developing machine 210 is again operated. If negative judgement is made, the process returns to Step 332. If affirmative judgement is made, that is, if the automatic developing machine 210 is again operated, the process proceeds to Step 304 in which the fan 52 is operated. At this point in time, unless the predetermined time elapses since the automatic developing machine 210 has been stopped, the flag F is reset in Step 306. Therefore, immediately after the fan 50 has been operated, the heater 50 is operated (Step 316). This immediate operation of the heater 50 is enabled by the following reason. The environment around the automatic developing machine 210 does not substantially vary, and therefore it is unnecessary to determine the set temperature of the drying air with reference to the map shown in FIG. 7. Accordingly, if that set temperature which was used in the preceding start-up of the machine 210 is applied in a non-modified form, the interior of the drying chamber 24 can be set at an optimum drying temperature. It is to be noted that since heat remains within the drying chamber 24 at the time of the re-start of the machine 210 after a short-term stoppage thereof, drying can be performed immediately.

The following is a description of the temperature control subroutine shown in FIG. 6B.

In Step 338, the temperature T is detected by the temperature detecting sensor 54, and the temperature T is substituted for Tr in Step 340. The process proceeds to Step 342. In Step 342, the film detecting sensor 260 detects the number of the film sheets 14 processed. In Step 344, judgement is made with respect to whether or not it is necessary to adjust the set temperature of the drying air in accordance with this number of film sheets processed. If it is judged that adjustment is needed, the process proceeds to Step 346 in which the set temperature Td of the drying air is adjusted with a compensation coefficient C, and the process proceeds to Step 348. If it is not judged that adjustment is not needed, the process jumps from Step 344 to Step 348. The compensation coefficient C corresponding to the number of film sheets processed is a value determined on the basis of the judgement which is made with respect to whether or not the number of film sheets processed exceeds a suitable number which can be processed by comparing the number of film sheets to be actually processed per unit time with the estimated number of film sheets which can be processed per unit time.

In Step 348, the set temperature Td of the drying air is compared with the actual temperature Tr of the drying air. If Td<Tr, the process proceeds to Step 350 in which the heater 50 is turned off since the temperature of the drying air is higher than the set temperature. Then, the process returns to the main routine shown in FIG. 6A. If Td>Tr, the process proceeds to Step 352 the heater 50 is tuned on since the temperature of the drying air is lower than the set temperature. Then, the process returns to that main routine. Also, if Td=Tr, the control exerted prior to the execution of this subroutine is continued, and the process returns to the main routine.

In the second embodiment, a single temperature detecting sensor can be used to detect the ambient temperature and the temperature of the drying air, and it is therefore unnecessary to separately incorporate an ambient temperature detecting sensor and a drying air temperature detecting sensor. Accordingly, it is possible to reduce the number of parts and hence the production cost.

It is to be noted that, in the second embodiment, by way of example, the amount of film 14 to be processed is represented by the number of the film sheets 14 detected by the film detecting sensor 260. However, as illustrated in the first embodiment, the area of the film processed may be used as the amount of film processed.

FIG. 8 illustrates the diagrammatic structure of a third preferred embodiment of an automatic developing machine to which the present invention is applied. In FIG. 8, the automatic developing machine is indicated generally at 410. In the third embodiment, like reference numerals are used to denote like or corresponding elements relative to those of the first and second embodiments, and the description thereof is omitted for the sake of simplicity.

This embodiment differs from the first and second embodiments in that no display device 51 is provided. More specifically, in this embodiment, the amount of the film to be actually processed within a predetermined time (per unit time) is compared with the amount of the film 14 which can be processed by the drying air at a set drying temperature thereof, and the set drying temperature is varied on the basis of the result of this comparison to allow for variations in the amount of the film 14 to be actually processed.

Similar to the film detecting sensor 260 of the second embodiment, the film detecting sensor 260 of the third embodiment is arranged to detect the number P of the film sheets 14 processed. The film detecting sensor 260 may be constituted by the photoelectric sensor illustrated in the second embodiment, a limit switch which can be turned on and off in accordance with the insertion of the film 14, or the like.

It is to be noted that the output terminals of the temperature detecting sensor 54 and the film detecting sensor 260 are connected to corresponding input terminals of a control device 462.

As shown in FIG. 9, the control device 462 includes the microcomputer 74 constituted by the CPU 64, the RAM 66, the ROM 68, the input port 70 and the output port 72, the A/D converter 76, the analog gate 78, and the driver 80.

The temperature detecting sensor 54 is connected through the analog gate 78 to the A/D converter 76 whose output terminal in turn is connected to the input port 70. The film detecting sensor 260 is connected to the input terminal of the input port 70 of the microcomputer 74.

The motor 42, the heater 50, and the fan 52 are connected to the corresponding output terminals of the driver 80, and are driven by control signals from the output port 72.

The CPU 64 of the microcomputer 74 performs arithmetic operations concerning the number of film sheets as obtained by the film detecting sensor 260 within each predetermined time (in this embodiment, one minute), constantly up-dating the totalized number A of film sheets which corresponds to a maximum of three intervals ($A_1$, $A_2$, $A_3$), and stores the result in the RAM 66. Also, the RAM 66 can be made to store the set temperature T of the drying air. The set drying temperature T may be stored in advance, or it may be set at any time by operating an operation knob (not shown). In addition, the RAM 66 is adapted to store a first predetermined level $L_1$ (in this embodiment $L_1=4$) representative of the upper limit of the number of film sheets to be processed, which is computed by the CPU 64 in accordance with the set temperature T of the drying air. The first predetermined level $L_1$ is compared with the number of film sheets which have actually been processed, to adjust the set drying temperature T.

It is to be noted that, in this embodiment, arithmetic operations are performed concerning a second predetermined level $L_2$ (in this embodiment $L_2=8$) which is above the first predetermined level $L_1$ and the result is stored in the RAM 66.

Figure 10:
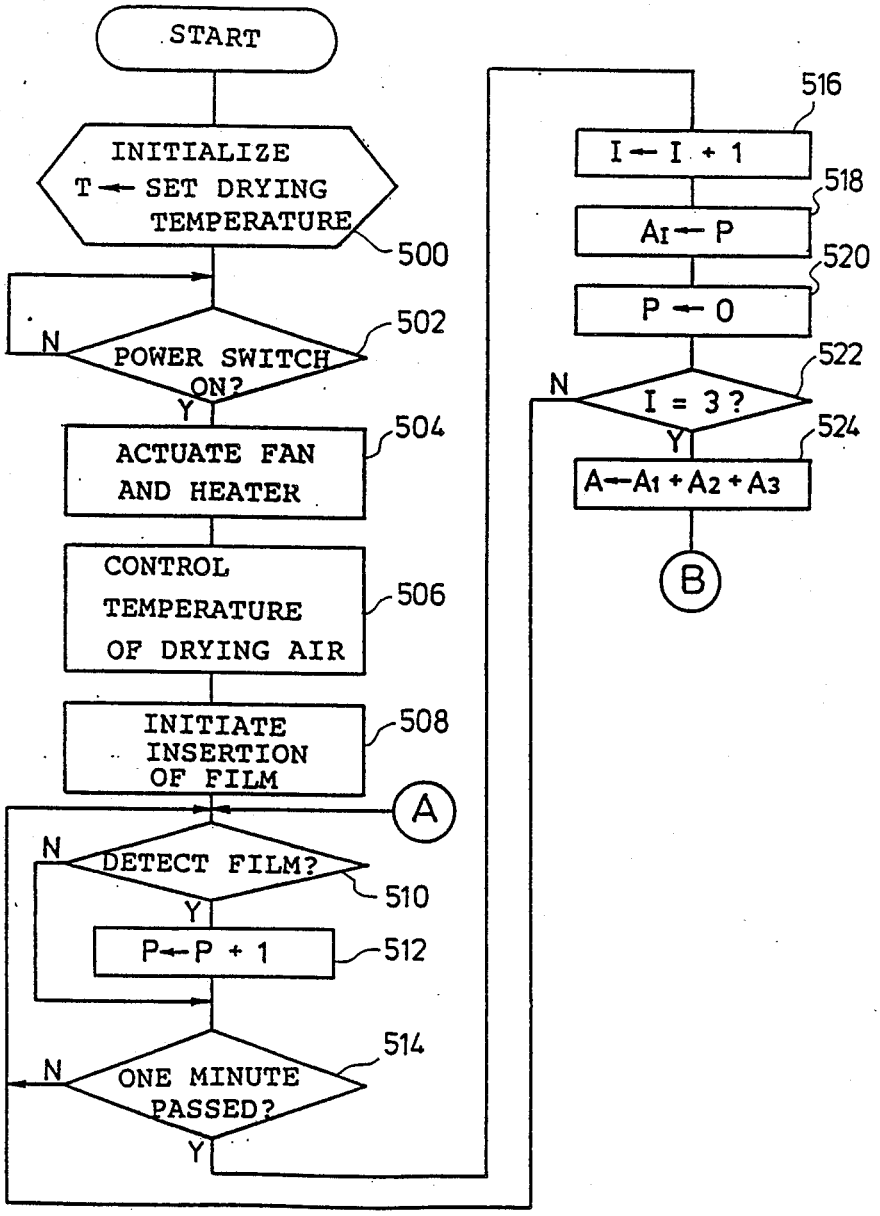
Figure 10:
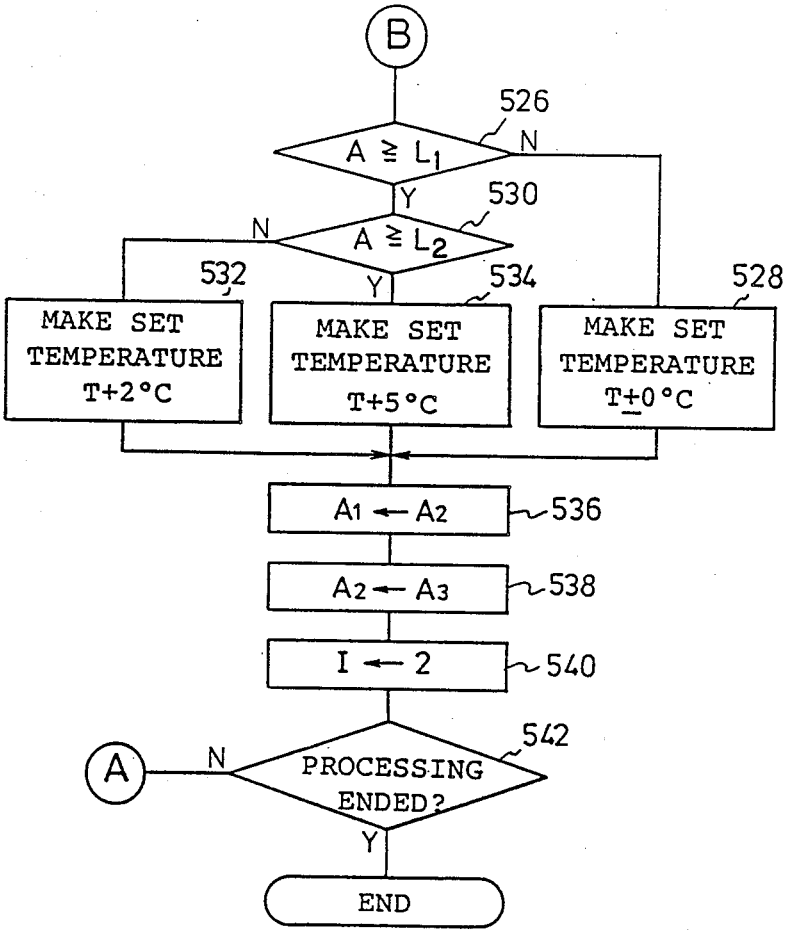

The operation of the third embodiment will be described below with reference to the flow charts shown in FIGS. 10 and 11.

In Step 500, values representing the number P of film sheets, the counted numbers $A_1$, $A_2$, $A_3$ at each one minute interval, and the totalized number A representing the sum of the counted numbers $A_1$, $A_2$, $A_3$ are initialized, and the set temperature of the drying air is stored as T. Then, the process proceeds to Step 502. The set temperature of the dry air is determined in advance by taking account of the number of film sheets to be processed within a predetermined time, the capabilities of the heater 50 and the fan 52, and other factors. In Step 502, judgement is made with respect to whether or not a power switch (not shown) of the machine 410 is turned on. If affirmative judgement is made, the process proceeds to the next Step 504. In Step 504, the heater 50 and the fan 52 are operated to increase the temperature in the drying chamber 24. In Step 506, the temperature of the drying air is controlled in accordance with the set temperature T of the drying air. When a temperature at which the film can be dried is reached, the process proceeds to Step 508, in which the introduction of the film 14 is initiated. Simultaneously, a time counter is operated as shown in FIG. 11. It is to be noted that while the power switch is OFF, the temperature of the drying air is consistently controlled. The film detecting sensor 260 is attached in the vicinity of the film inserting inlet 12. In Step 510, the film sheet 14 is detected on the basis of the output signals of the film detecting sensor 260. When the film detecting sensor 260 detects the presence of the film sheet 14, the film detecting sensor 260 outputs a pulse signal such as that shown in FIG. 11. When the film sheet 14 is detected, the process proceeds to Step 512, in which the number P of film sheets is incremented, and then to Step 514.

While the film sheet 14 is not being detected, that is, during an interval, the process jumps from 510 to Step 514.

In Step 514, judgement is made with respect to whether or not one minute has elapsed since the detection of the film sheet 14 was initiated. If it is judged that one minute has not yet passed, the process returns to Step 510, in which detection of the film sheet 14 is continued. If it is judged that one minute has passed (the time counter shown in FIG. 11 has been inverted), the process proceeds to Step 516, in which a variable I (its initial value =0) is incremented. Then, the process proceeds to Step 518 in which the number of film sheets counted in one minute is substituted for $A_1$, and proceeds to Step 520. In Step 520, the number P of film sheets is reset, and the process proceeds to Step 522 in which judgement is made with respect to whether or not the aforesaid variable I is 3. If negative judgement is made, it is determined that all the data ($A_1$, $A_2$, and $A_3$) required for temperature control has not yet been prepared. The process returns to Step 510, and Steps 510 through 520 are repeated. When Steps 510 through 520 are repeated three times, the variable I goes to 3. When affirmative judgement is made in Step 522, the process proceeds to Step 524. In this manner, all the data $A_1$, $A_2$, and $A_3$ is prepared and thus the adjustment of temperature setting is initiated (as indicated by double-headed arrows A in FIG. 11).

In Step 524, all the values represented by the data $A_1$, $A_2$, and $A_3$ are summed up, and the totalized number A of film sheets processed is obtained. Then, the process proceeds to Step 526. In Step 526, the totalized number A is compared with the predetermined number $L_1$ of film sheets processed. If negative judgement is made, it is determined that the film can sufficiently at the present temperature. The process proceeds to Step 528 in which the set temperature of the drying air is not modified, and then proceeds to Step 536. Also, if affirmative judgement is made in Step 526, it is judged that a predetermined number of film sheets to be processed is exceeded, and the process proceeds to Step 530. In Step 530, the totalized number A is compared with the predetermined number $L_2$ ($L_2 > L_1$), and judgement is made concerning to what extent the predetermined number $L_2$ is exceeded. If the totalized number A does not exceed the predetermined number $L_2$, it is determined that the film can be dried, and the set temperature T of the drying air is raised to a small degree (in this embodiment by 2° C.). Then, the process proceeds to Step 536. On the other hand, if the totalized number A exceeds the predetermined number $L_2$, it is judged that the capacity of drying the film 14 lowers, that is, that the humidity in the drying chamber 24 is high or the temperature in the same is low, and the set temperature T of the drying air is raised to a large degree (in this embodiment by 5° C.). Then, the process proceeds to Step 536. When the set temperature T of the drying air is adjusted in the above-described manner, the temperature of the drying air is controlled on the basis of the resultant adjustment.

In Step 536, the value of the aforesaid data $A_2$ is substituted for $A_1$ (as indicated at [$A_1$] in FIG. 11). Then, the process proceeds to Step 538, in which the value of the aforesaid data $A_3$ is substituted for $A_2$ (as indicated at [$A_2$] in FIG. 11). This process is executed so that the oldest data obtained more than at least three minutes ago may be reset to provide the totalized number A of film sheets processed for a period from the present time back to three minutes ago and new data obtained between the present time and one minute ago is substituted for $A_3$ (as indicated at [$A_3$] in FIG. 11). In Step 540, 2 is substituted for the variable I, and judgement is made in Step 542 with respect to whether or not one sequence of process has been completed. If the process has been completed, the temperature control is terminated. If the process is continued, the process proceeds to Step 510, in which the number P of film sheets introduced between the present time to one minute later is obtained. After one minute has passed, 3 is substituted for the variable I in Step 516. Therefore, new data is substituted for $A_3$ ([$A_3$]) in Step 518, and thus the totalized number A of film sheets from the present time to three minutes ago is obtained (as indicated as [A ] in FIG. 11).

Accordingly, the number of film sheets processed from the present time to three minutes ago can be detected each time one minute passes by repeating the above-described control. In consequence, the environment within the drying chamber which varies with time can consistently be maintained in an optimum state in accordance with the number of the film sheets 14 processed.

In this embodiment, since it is sufficient that only the temperature of the drying air is detected, it is unnecessary to incorporate any sensor for detecting the ambient temperature and ambient humidity around the automatic developing machine. This leads to a reduction in the production cost.

In this embodiment, although the amount of film to be processed is represented by the number of film sheets to be processed by way of example, the area of film to be processed may be employed as that amount.

Also, in the respective photographic processing machine to which the first to three embodiments are applied, only a section downstream of the developing chamber is illustrated for convenience. However, the photographic processing machine may include an image recording device which constitutes a fourth embodiment which will be described below.

FIG. 12 illustrates the diagrammatic structure of the fourth preferred embodiment of a photographic processing machine to which the present invention is applied. In FIG. 12, the photographic processing machine is indicated generally at 610.

The photographic processing machine 610 includes an image recording chamber 612 and an automatic developing chamber 614. A cassette 618 which accommodates a photographic light-sensitive material 616 such as a film sheet is loaded in the image recording chamber 612. A suction cup 620 is disposed above the cassette 618 so as to attract by suction the uppermost one of the light-sensitive material 616 accommodated in the cassette 618. The light-sensitive material 616 is introduced along a conveyance path 622 to an exposure chamber 624.

After completion of exposure, the light-sensitive material 616 is conveyed into the automatic developing chamber 614, passed through a developing bath 626, a fixing bath 628 and a washing bath 630, dried in a drying chamber, and discharged from the photographic processing machine 610. Racks 636 each having a plurality of guide rollers 634 are placed in each of the developing bath 626, the fixing bath 628, and the washing bath 630, respectively. The light-sensitive material 616 is guided by the racks 636 and is immersed in each processing liquid. As illustrated, each pair of guide rollers 638 is disposed generally above the boundary between the developing bath 626 and the fixing bath 628 as well as the boundary between the fixing bath 628 and the washing bath 630, the light-sensitive material being conveyed from one of the baths to another by the respective pairs of guide rollers 638. A plurality of rollers 640 are disposed generally above the washing bath 630 so as to convey the washed light-sensitive material 616 upwardly to the drying chamber 632. It is to be noted that each of these rollers is rotated by the drive force of a motor (not shown).

Within the drying chamber 632, a pair of guide rollers 642 are disposed above an opening which is located above the guide rollers 640, and the guide rollers 642 are rotatably supported by a frame 644 of the drying chamber 632. A guide plate 646 having an approximately quartered arcuate cross section is disposed above the guide rollers 642. The light-sensitive material 616 is conveyed along the guide plate 646 in the horizontal direction. A plurality of pairs of conveyance rollers 648A and 648B (in this embodiment five pairs) are supported by the drying chamber frame 644 in such a manner that these pairs are aligned horizontally. The respective pairs are rotated by the drive force of a drive belt 650 to convey the light-sensitive material 616 toward a discharge port 651.

The light-sensitive material 616 is conveyed substantially horizontally by the pairs of conveyance rollers 648A and 648B. In the vicinity of the opposite surfaces of the light-sensitive material 616, a plurality of air pipes 652 are arranged in such a manner that their longitudinal axes are parallel to the direction in which the light-sensitive material 616 is conveyed.

One end of the respective air pipes 652 communities with a duct 658 through which warm air supplied by the blower 654 and produced by the heater 656 is made to flow, and this communication is provided oh one longitudinal side of the drying chamber 632. A slit 660 is formed in each of the air pipes 652 along its length so that warm air is supplied through each slits 660. This warm air is applied to the opposite surfaces of the light-sensitive material 616, thereby drying the washed light-sensitive material 616.

A first temperature detecting sensor 662 for detecting the temperature of drying air is attached to an inner wall of the duct 658, and a signal line 664 is connected to a controller 666 for controlling the operation of the aforesaid heater. The temperature in the drying chamber 632 is previously set in the controller 666. The temperature detected by the first temperature detecting sensor 662 is fed back to the controller 666 to control the operation time of the heater 656, thereby maintaining the temperature of the drying air at that set temperature.

Also, a signal line 670 of a second temperature detecting sensor 668 is connected to the controller 666. The second temperature detecting sensor detects the ambient temperature of the ambient air around the photographic processing machine 610. The aforesaid set temperature can be modified in accordance with the temperature detected by the second temperature detecting sensor 668.

The manner in which the set temperature is modified is previously stored as a map such as that shown in FIG. 14. If three values of the ambient temperature are selected by way of example, the corresponding set temperatures are as shown in the following table.

TABLE

| AMBIENT TEMPERATURE (°C.) | SET TEMPERATURE OF DRYING AIR (°C.) |
|---|---|
| 32 | 55 |
| 25 | 50 |
| 15 | 45 |

As can be seen from the above table, if the ambient temperature of the ambient air is high (32° C.), the temperature of the drying air when it is blown is made high (55° C.). On the other hand, if the ambient temperature is low (15° C.), the temperature of the drying air when it is blown is made low (45° C.).

The following is a description of the present embodiment.

The light-sensitive material 616 is unloaded from the cassette 618 by the suction of the suction cup 620, exposed in the exposure section 624, and introduced to the automatic developing chamber 614.

In the automatic developing section 614, the light-sensitive material 616 is conveyed through the developing bath 626, the fixing bath 628 and the washing bath 630, passed through the opening 632A, and introduced into the drying chamber 632.

Warm air is supplied through the heater 656 by the blower 654 to the air ducts 652, and is blown through the slits 660 formed in the air ducts 652 in the drying chamber 632. The temperature in the duct 658 is detected by the first temperature detecting sensor 662, and the detected temperature is fed back to the controller 666. In the controller 666, the fed back temperature of the drying air is compared with the set temperature set by the controller 666 to control the operation time of the heater 656, thereby maintaining the temperature of the drying air at a substantially constant temperature (the set temperature).

However, since variations in the ambient temperature affect the relative humidity of the drying air, the photographic processing machine 610 of the present invention is arranged so that the ambient temperature is detected by the second temperature detecting sensor 668 to modify the set temperature of the drying air when it is blown, thereby maintaining the humidity in the drying chamber 633 at a substantially constant level.

More specifically, when the temperature detected by the second temperature detecting sensor 668 is supplied to the controller 666, the set temperature of the drying air suitable for this detected ambient temperature can be selected from the map shown in FIG. 14. The controller 666 provides feed-back control over the temperature of the drying air on the basis of the newly set temperature. Therefore, the relative humidity in the drying chamber 632 does not substantially vary.

For example, in a case wherein the ambient temperature is 15° C. when the photographic processing machine 610 is started, the set temperature is determined so that the temperature of the drying air when it is blown may be 45° C. When the ambient temperature reaches 25° C. while the machine 610 is operating, the temperature of the drying air when it is blown is correspondingly raised to 50° C. Therefore, at least imperfect drying of the light-sensitive material is not prevented.

Thus, the set temperature is modified each time the second temperature detecting sensor 668 detects the ambient temperature. However, the temperature detection is not consistently carried out by the second temperature detecting sensor 668. The temperature may be detected at intervals of, for example, three minutes or one hour to modify the set temperature.

It is to be noted that, even if the ambient temperature varies, the relative humidity of the drying air when it is blown can be maintained at a substantially constant level irrespective of variations in the ambient temperature.

In this forth embodiment, the set temperature in the drying chamber 632 is adjusted solely in accordance with variations in the ambient temperature. However, control as described below may be carried out in parallel.

In this temperature control method, two set temperatures $t_1$ and $t_2(t_2>t_1)$ are previously stored in the controller 666. Until the count of the number of the light-sensitive materials 616 reaches a predetermined number or until the time required for drying the film reaches a predetermined time, the set temperature of the drying air is substituted for $t_1$, and feed-back control is performed. After the predetermined number has been counted, or after the predetermined time has passed, the set temperature is substituted for $t_2$, and feed back control is performed.

According to this method, after a predetermined number of the light-sensitive materials 616 have been dried or after a predetermined time has passed, the temperature of the rollers 648A and 648B is caused to decrease by moisture carried by the surfaces of the light-sensitive material 616, so that the efficiency of drying lowers. However, if the temperature of the drying air is raised to $t_2$ higher than $t_1$, further optimum control can be provided over the drying process.

FIG. 15 illustrates the diagrammatic structure of a fifth preferred embodiment of an automatic film developing machine to which the present invention is applied. In FIG. 15, 710 is an automatic film developing machine according to the fifth preferred embodiment of the present invention. In this fifth embodiment, like reference numerals are used to denote like or corresponding elements relative to those first embodiment.

Film 14 is conveyed through a film inserting inlet 12 into the automatic developing machine 710. In the interior of the automatic developing machine 710, the film 14 is guided by guide rollers 16, passed through a developing bath 18, a fixing bath 20 and a washing bath 22, and conveyed into a drying chamber 24. Racks 28 each having a plurality of guide rollers 26 are placed in the developing bath 18, the fixing bath 20, and the washing bath 22, respectively. In each of the baths, the film 14 is conveyed downwardly from the liquid surface to the bottom by means of the guide rollers 26 of the racks 28. After the film 14 is returned upwardly at the bottom of the each bath to be conveyed toward the liquid surface. In this manner, the film 14 is immersed in the respective baths and conveyed by the rollers 16 of the racks 28.

As illustrated, a plurality of guide rollers 30 are disposed above the boundary between the developing bath 18 and the fixing bath 20 as well as the boundary between the fixing bath 18 and the washing bath 22. Therefore, the film 14 is guided by the guide rollers 30 from each bath to the adjacent one. A plurality of rollers 32 are disposed between the washing bath 22 and the drying chamber 24 so as to guide the film 14 into the drying chamber 24. It is to be noted that an additional function of these rollers 32 is to squeeze the film 14 to wipe off water, at least in part, remaining on the surfaces of the film 14.

In the drying chamber 24, a plurality of conveying rollers 34 are disposed in such a manner that the rollers 34 are vertically equally spaced each other as viewed in FIG. 15. Therefore, the film 14 is conveyed substantially straight from the top of the drying chamber 24 to the bottom by the conveying force given by the rotation of the conveying rollers 34. A guide plate 36 is disposed at a lower portion of the drying chamber 24 so as to turn the film 14 toward a right-hand wall (as viewed in FIG. 15) of a frame 10A of the developing machine 710. The film 14, in turn, is conveyed by the conveying force of a drive roller 38 into a film receiving box 40 attached to an outer wall of the frame 10A.

The drive roller 38 is linked with a motor 42 through a belt 44, and the drive roller 38 is rotated through that belt 44 by the drive force of the motor 42 through the belt. It is noted that the rollers disposed in the automatic developing machine 710 are linked to the drive roller 38 through chain means, belt means or geared transmission (neither of which is shown) so that all the rollers may be rotated at the same time.

An intake duct 46 and a discharge duct 48 are connected to portions of a partition wall 24A of the drying chamber 24, thereby providing communication between the exterior and the drying chamber 24. A heater 50 is connected to the intake duct 46 through a fan 52. The outside air is introduced into the intake duct 46 by the rotation of the fan 52, and in turn is heated by the heater 50. Thereafter, the warm air thus produced is supplied to the drying chamber 24. The film 14 and the conveying rollers 34 are dried by the warm air, and the resultant wet air is discharged through the discharge duct 48 from the automatic developing machine 710.

The automatic developing machine 710 is provided with a main power switch as well as a start switch (not shown) for actuating the motor 42, the heater 50 and the fan 52. The motor 42, the heater 50 and the fan 52 can be actuated by turning on the respective start switch.

A temperature detecting sensor 54 is disposed in the drying chamber 24 for detection of the temperature of the drying air. A sensor 56 for detecting the temperature of the outside air and a sensor 58 for detecting the humidity of the outside air are disposed on a portion of the outer wall of the automatic developing machine 710. Further, a plurality of film detecting sensors 760 (one of which is shown) are disposed in the vicinity of the film inserting inlet 12 across the width of the film 14 so as to detect the amount of film 14 to be processed. The processing machine 710 of this embodiment is set to process a predetermined amount of the film 14 at constant intervals. However, for example, in case that the film 14 is inserted into the processing machine 710 at shorter intervals than the constant intervals or the film 14 of the amount exceeding the predetermined amount is inserted into the processing machine 710, such an abnormal case is detected by the film detecting sensors 60. The data detected by the sensors 60 can be applied for such a secondary secondary control of the processing machine 710 that the insertion of the film 14 is stopped until the temperature in the drying chamber is recovered at which the film can be dried.

The drying air temperature detecting sensor 54, the outside air (ambient) temperature detecting sensor 56, the outside air (ambient) humidity detecting sensor 58, and the film detecting sensors 60 are connected to a control device 62.

As shown in FIG. 16, the control device 762 includes a microcomputer constituted by a CPU 64, a RAM 66, a ROM 68, an input port 70 and an output port 72, an A/D converter 76, an analog gate 78, and a driver 80.

The drying air temperature detecting sensor 54, the outside air temperature detecting sensor 56, and the outside air humidity detecting sensor 58 are connected to the corresponding inputs of the analog gate 78. The output signals of the analog gate 78 are supplied through the A/D converter 76 to the input terminal of the input port 70 of the microcomputer 74. The film detecting sensor 60 is connected through the A/D converter 76 to the input port 70.

The motor 42, the heater 50 and the fan 52 are connected to the corresponding output terminals of the driver 80, and are driven by control signals from the output port 72.

The temperature in the drying chamber (the temperature of the drying air) can be determined on the basis of the ambient temperature and the ambient humidity. FIG. 18 is a characteristic chart illustrating the relationship between the drying temperature in the drying chamber and the ambient humidity regarding the ambient temperature. The characteristic chart shows maximum temperature in the drying chamber at which the film 14 is not dried excessively on the basis of the ambient humidity regarding each ambient temperature, i.e., curves of optimum temperatures in the drying chamber for drying the film to an optimum condition (hereinafter referred to as an optimum drying temperature curve). The map which shows the relationship between the humidity detected by the ambient humidity detecting sensor 58 and the temperature in the drying chamber is stored in the RAM 66 of the microcomputer 74 on the basis of the optimum drying temperature curve. It is to be noted that such a map should be prepared regarding each of the ambient temperatures but FIG. 19 shows the map about the ambient temperature 25° C., as one example.

In FIG. 19 a curve A is the same as the optimum drying temperature curve shown in FIG. 18. Therefore, the size of the film 14 which has been just dried can be made equal substantially to the size of the film which has been just exposed by controlling the temperature in the drying chamber on the basis of the curve A. That is to say, since the water content of the film 14 at the time of exposure depends on the ambient humidity, the film 14 washed is dried by the water amount where the water content of the film at the time of exposure is deducted from the total water content of the film washed, so that the water content of the film which has been just dried can be made equivalent to the ambient humidity. The curve A is a characteristic chart which can be obtained from the experimental results. The film 14 can be dried up to an optimum condition by controlling the temperature in the drying chamber on the basis of the curve A.

Next, a curve B shows a minimum level of the temperature in the drying chamber where the film 14 can be dried up to an allowable condition (herein referred to as a minimum drying temperature curve). Even if the films are dried in the drying chamber set at a temperature of less than the temperature shown with the curve B, the dryness thereof becomes insufficient. If the films 14 dried insufficiently are put in piles, they may stick each other. Accordingly, in this embodiment the temperature in the drying chamber is controlled to a preferable drying temperature region which is defined by a lower limit shown with the minimum drying temperature curve (curve B in Gig. 19) and an upper limit shown with the optimum drying temperature curve (the curve A in FIG. 19).

In case that the film is dried in the drying chamber set at a temperature which is closer to the curve B in the preferable drying temperature region, the film which has been just dried has a water content which is slightly more than that of the film which has been just exposed. However, if the film is put in the ambient condition (ambient air), it will be dried (in 2 to 30 minutes) up to the condition substantially equivalent to the humidity (water content) in the ambient condition.

As shown in FIG. 19, the curves A and B are provided with an upper limit temperature and a lower limit temperature irrespective of the (ambient) temperature and the (ambient) humidity of the ambient condition. The upper limit temperature is about 70° C. If the film is dried in the drying chamber having a temperature of more than 70° C., the deformation of the film may take place. Therefore, in such a case that the film must theoretically be dried in the drying chamber set at a temperature of more than 70° C., the film can be dried to the allowable condition, as one means, by setting the temperature in the drying chamber to a temperature of less than 70° C. and prolonging the drying time of the film.

Also, the lower limit temperature is the ambient temperature. Setting the temperature in the drying chamber to a temperature of less than the ambient temperature means substantially cooling the drying chamber.

The most preferable result can be obtained theoretically regarding the stability of size of the film by providing a cooling device in the machine 710 and cooling the temperature in the drying chamber to a temperature of less than the ambient temperature by the cooling device. However, it is not practical to provide the cooling device in the machine 710 in view the space and the costs required for provision of the cooling device. In this case it will be effective to stop the heater 50 and the fan 52 or shorten the drying time of the film.

In this embodiment another curve $\alpha$ is established by shifting the optimum drying temperatures curve (the curve A in FIG. 19) to a side of the excessive dryness of the film by a predetermined temperature. The curve $\alpha$ shows a allowable range where the temperature in the drying chamber can be set to the side of the excessive dryness beyond the curve A. In other words, in case that the temperature in the drying chamber is a temperature of the curve $\alpha$ or less, the size error occurs in the film dried but it can be disregarded since a changing ratio of the size between the film which has been just dried and the film which has been just exposed is 0.005% or so.

It is to be noted that the difference between the curve $\alpha$ and the curve A in FIG. 19 is 7° C.

The following is a description of the operation of the fifth embodiment with the reference to the flow chart of the FIG. 17.

When the power switch (not shown) of the automatic developing machine 710 is turned on, a program is started.

In step 800, the heater 50 and the fan 52 are operated under on-off control to preheat the drying chamber 24 up to a temperature at which the film can be dried.

In step 802 the ambient humidity h is detected by the ambient humidity detecting sensor 58, and in step 804 the ambient temperature ti is detected by the ambient temperature detecting sensor 56, thereafter proceeding to step 806.

In step 806 the temperature T in the drying chamber required for drying the film is determined from the map shown in FIG. 19 on the basis of the ambient humidity h detected in step 802 and the ambient temperature t detected in step 804.

In the step 808 the temperature t2 of the drying air is detected by the drying air temperature detecting sensor 54, and in step 810 the temperatures T and t2 are compared with each other. When the temperature T ≠ the temperature t2 in step 810, the step proceeds to step 812 where the heater 50 is operated under on-off control.

When the temperature T ≠ the temperature t2 in step 810, the step is ended.

In this embodiment, as described above, since the temperature in the drying chamber is determined on the basis of not only the ambient temperature but also the ambient humidity, it is unnecessary to set the temperature in the drying chamber to a unnecessarily high temperature in order to prevent the film from being dried insufficiently. As a result, the film can be prevented from an excessive dryness, so that the elasticity of the film 14 is kept in a preferable condition. Thus, even though the size of the film is slightly changed in the course of the developing process, the film which has been just dried can be kept in the substantially same size as the film which has been just exposed, so that the film dried can be kept in a preferable size with a high accuracy.

In this embodiment, also, the temperature in the drying chamber to be set has a predetermined allowable range (the drying temperature region), so that the control of the temperature in drying chamber can be conducted rapidly, particularly it can be applied with a simple on-off control.

It is to be noted that, even if the water content of the film which has been just dried is slightly more than the ambient humidity in some cases, the film is dried to a preferable condition within a short time (2~30 minutes), which is no problem.

What is claimed is:

1. A method of drying photographic light-sensitive material by use of drying air after said photographic light-sensitive material has been processed in a processing machine for photographic light-sensitive material, comprising the steps of:

(a) setting drying temperature of said drying air necessary for drying a predetermined amount of said processed light-sensitive material within a predetermined time;

(b) periodically performing arithmetic operations concerning the totalized amount of said light-sensitive material to be actually dried within said predetermined time; and (c) making a comparison between said predetermined amount of said light-sensitive material and said totalized amount, thereby adjusting said set temperature of the drying air on the basis of the result of said comparison.

2. A method of drying photographic light-sensitive material according to claim 1, wherein said set temperature of the drying air in said step (a) is determined on the basis of the ambient temperature around said processing machine for the light-sensitive material.

3. A method of drying photographic light-sensitive material according to claim 1, wherein said set temperature of the drying air in said step (a) is determined on the basis of the ambient temperature and humidity around said processing machine for the light-sensitive material.

4. A method of drying photographic light-sensitive material according to claim 1, wherein said totalized amount of said light-sensitive material in said Step (b) is the totalized number of said light-sensitive material.

5. A method of drying photographic light-sensitive material according to claim 1, wherein said totalized amount of said light-sensitive material in said Step (b) is the totalized area of said light-sensitive material.

6. A method of drying photographic light-sensitive material according to claim 1, wherein said predetermined amount of the light-sensitive material in said Step (a) is determined as a first predetermined amount and a second predetermined amount which is larger than said first predetermined amount, and wherein, in said Step (b), when said totalized amount of said light-sensitive material is not less than said first predetermined amount and less than said second predetermined amount, said set temperature of the drying air is increased by a first predetermined temperature, whereas, when said totalized amount of said light-sensitive material is not less than said second predetermined amount, said set temperature of the drying air is increased by a second predetermined temperature which is higher than said first predetermined temperature.

7. An apparatus for drying photographic light-sensitive material by use of drying air in a drying chamber after said photographic light-sensitive material inserted in a photographic processing machine for processing light-sensitive material, at arbitrary intervals, has been processed in said photographic processing machine, comprising:

a first sensor means for detecting ambient temperature around said photographic processing machine;

a second sensor means for detecting the temperature of said drying air;

a detecting means for detecting the amount of said light-sensitive material to be actually processed within a predetermined time by said processing machine;

an arithmetic means for performing arithmetic operations based upon the amount of said photographic light-sensitive material which can be dried within said predetermined time on the basis of said ambient temperature detected by said first sensor means and said temperature of said drying air detected by the second sensor means; and a control means for controlling one of said temperature of said drying air and said light-sensitive material inserting intervals by comparing the result of arithmetic operations of said arithmetic means with said amount of said light-sensitive material to be actually processed.

8. An apparatus for drying photographic light-sensitive material according to claim 7, further comprising a display means for selectively displaying a first sign meaning that said processing machine is ready for insertion of said light-sensitive material and a second sign meaning that said processing machine is not ready for insertion of said light-sensitive material, said control means causing said display means to display the second sign when said amount of said photographic light-sensitive material processed exceeds said result of arithmetic operations.

9. An apparatus for drying photographic light-sensitive material according to claim 8, wherein said first temperature sensor means is disposed outside said photographic processing machine and said second temperature sensor means is disposed inside said photographic processing machine.

10. An apparatus for drying photographic light-sensitive material according to claim 9, further comprising a humidity sensor means disposed outside said photographic processing machine for detecting the ambient humidity around said photographic processing machine, said arithmetic means arranged to perform arithmetic operations upon the amount of said photographic light-sensitive material which can be processed per unit time on the basis of said ambient temperature detected by said first temperature sensor means, said temperature of said drying air detected by said second temperature sensor means, and said ambient humidity detected by said humidity sensor means.

11. An apparatus for drying photographic light-sensitive material according to claim 10, wherein said detecting means is constituted to detect the number of said photographic light-sensitive material.

12. An apparatus for drying photographic light-sensitive material according to claim 10, wherein said detecting means is constituted to detect the area of said photographic light-sensitive material.

13. An apparatus for drying photographic light-sensitive material according to claim 1, further comprising a drying air supplying means for supplying said drying air to said drying chamber.

14. An apparatus for drying photographic light-sensitive material according to claim 13, wherein said drying air supplying means includes a fan for supplying said ambient air to said drying chamber, and a heater for producing warm air by heating said ambient air before said ambient air is supplied to said drying chamber.

15. An apparatus for drying photographic light-sensitive material according to claim 14, wherein said control means is constituted to control said temperature of said drying air by controlling said heater.

16. For use in a photographic processing machine for processing photographic film sheets at arbitrary intervals, an apparatus for drying said photographic film sheet which is processed in said photographic processing machine, comprising:

a means for drying said photographic film sheet which is processed;

ambient temperature detecting sensor disposed outside said photographic processing machine for detecting the temperature of the ambient air around said processing machine;

a drying air temperature detecting sensor disposed inside said photographic processing machine for detecting the temperature of said drying air;

an inserted-film detecting means for detecting the amount of said film sheet inserted in said photographic processing machine;

an arithmetic means for performing arithmetic operations upon the amount of said photographic film sheet which can be dried within a predetermined time on the basis of said ambient temperature detected by said ambient temperature detecting sensor and said temperature of said drying air detected by drying air temperature detecting sensor;

a comparing means for comparing the result of arithmetic operations by said arithmetic means with said amount of said film sheet to be actually processed; and a display means for displaying a sign meaning that the processing machine is not ready for insertion of the film sheet when the result of the comparison performed by said comparing means represents the fact that said amount of said film sheet inserted in the processing machine exceeds said result of said arithmetic operations.

17. An apparatus for drying photographic film sheet according to claim 16, further comprising control means for controlling said drying means to cause the temperature of said drying air to reach a predetermined temperature.

18. An apparatus for drying a photographic film according to claim 17, wherein said drying means comprises a fan for introducing ambient air around said processing machine and a heater for heating said ambient air to produce said drying air.

19. An apparatus for drying photographic film sheet according to claim 18, wherein said control means is constituted to control said heater thereby controlling said drying air so that the temperature of said drying air may reach said predetermined temperature.

20. An apparatus for drying a photographic film sheet according to claim 19, further comprising an ambient humidity detecting sensor for detecting the humidity of said ambient air, said arithmetic means being arranged to perform arithmetic operations upon said amount of said film sheet to be processed on the basis of the ambient temperature, the temperature of said drying air, and the ambient humidity.

* * * * *